US006450291B1

(12) United States Patent
Ono

(10) Patent No.: US 6,450,291 B1
(45) **Date of Patent: *Sep. 17, 2002**

(54) FRAMES AND STRUCTURES ASSEMBLED BY SAME

(75) Inventor: Tatsuo Ono, Tokyo (JP)

(73) Assignee: Nisso Sangyo, Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/141,983

(22) Filed: Aug. 28, 1998

(30) Foreign Application Priority Data

Dec. 26, 1997 (JP) ..... 9-369452
Apr. 29, 1998 (JP) ..... 10-134302

(51) Int. Cl.[7] ..... E04G 7/00

(52) U.S. Cl. ..... 182/178.1; 152/178.6; 152/179.1

(58) Field of Search ..... 182/27, 130, 152, 182/153, 154, 155, 178.1, 178.2, 178.3, 178.4, 178.5, 178.6, 179.1, 186.6, 186.7, 186.8

(56) References Cited

U.S. PATENT DOCUMENTS 2,758,379 A * 8/1956 Senk ..... 182/178.6 X
3,011,586 A * 12/1961 Harvey, Jr. ..... 182/152
3,212,605 A * 10/1965 Dickerson ..... 182/152
3,235,038 A * 2/1966 Nesslinger ..... 182/152
3,498,016 A * 3/1970 Nowak ..... 182/178.1 X
3,533,592 A * 10/1970 Jennings ..... 182/130 X
3,647,080 A * 3/1972 Denny ..... 211/176
3,656,269 A * 4/1972 Witschel et al. ..... 182/178.1 X
3,684,058 A * 8/1972 Brown ..... 182/178.6 X
3,724,595 A * 4/1973 Green ..... 182/178.6 X
3,835,612 A * 9/1974 Beziat ..... 182/178.5 X
4,136,785 A * 1/1979 McDevitt ..... 182/178.1 X
4,249,636 A * 2/1981 Jackson et al. ..... 182/152
5,070,965 A * 12/1991 Jordan, III ..... 182/113
5,135,077 A * 8/1992 Shalders ..... 182/178.1 X
5,555,954 A * 9/1996 Swiderski ..... 182/152
5,617,931 A * 4/1997 Zygmun et al. ..... 182/145
5,865,270 A * 2/1999 Strength et al. ..... 182/186.6
6,152,263 A * 11/2000 Van Oers et al. ..... 182/179.1

* cited by examiner

*Primary Examiner*—Bruce A. Lev
(74) *Attorney, Agent, or Firm*—McGlew and Tuttle, P.C.

(57) ABSTRACT

A fram with a support post, a first connector support member mounted at an intermediate position of the post and a second connector support member or members mounted at an upper or lower position, or both the upper and the lower positions, of the support post. A lateral member is secured to a side portion of the support post in a fixed, removable or rotatable state. A connector is mounted at an outer end of the lateral member at a vertical position corresponding to the first or the second connector support member.

20 Claims, 38 Drawing Sheets

(A)

(B)

(A)

(B)

(A)

(B)

(A)

(B)

(A)

(B)

FRAMES AND STRUCTURES ASSEMBLED BY SAME

BACKGROUND OF THE INVENTION

The present invention relates to structures such as prefabricated scaffolding, shoring and support beam, as well as frames used for assembling the structures.

Generally, in a construction work or a civil engineering work, a prefabricated scaffolding for workers to walk thereon is installed opposedly to the outer side faces of a structure.

Likewise, in a construction work, a civil engineering work, or a bridge building work or the like, there is used a shoring or a support beam to support heavy objects such as floor and bridge girder during the work.

Prefabricated scaffolding, shoring and support beam each employ frames which are assembled lengthwise and crosswise. For example, what is called PAL SUPPORT® is used as a frame exclusive for shoring. The PAL SUPPORT® is constituted by a frame which is triangular in plan and which comprises a single strut, a V-shaped lateral member connected laterally to the strut, and a connector provided at an outer end of the lateral member and having a hole.

In the PAL SUPPORT®, struts are fitted together in the longitudinal direction and the frames are assembled in multi-stages in the vertical direction. Also in the transverse direction the frames are arranged in a large number of rows, and the hole of the connector on one frame side of adjacent frames is fitted on the upper portion of the strut on the other frame side to connect the frames successively in the transverse direction.

In the prefabricated scaffolding, as disclosed, for example, in Japanese Patent Laid Open No.42161/94, a large number of gate-shaped building frames called BEATTY SCAFFOLDING® are arranged transversely at appropriate spacings while allowing them to face in the longitudinal direction, and scaffolding boards are removably mounted longitudinally between the building frames. Further, the building frames adjacent in the transverse direction are connected together through braces which cross in X shape. The gate-shaped building frames each comprise two vertical struts which are upright in parallel with each other and a horizontal member which connect the struts integrally with each other. The building frames are placed in the longitudinal direction in which their horizontal members are perpendicular to the outer faces of the structure.

Since the frames used in the above shoring, prefabricated scaffolding and support beam are special frames formed for the respective purposes, they cannot be used in common to all of the structures, that is, they are not versatile and are therefore uneconomical.

In many cases, moreover, conventional frames are not fabricated as single products but are assembled by combining with other components of different structures, thus resulting in an increase in the number of components. Besides, the work for combining discrete components is troublesome. Under the circumstances, a demand exists for the development of a frame which can be assembled easily even by unskilled workers and which is superior in working efficiency and economical.

On the other hand, the foregoing PAL SUPPORT® is advantageous in that it can be assembled lengthwise and crosswise as a single product. However, when the connector on one strut side is brought into engagement with another strut and when there later arises the necessity of removing or replacing a certain portion during work or after assembly, the vertical struts must once be pulled out, which work is very difficult and troublesome.

The foregoing prefabricated scaffolding has been familiarized in construction and civil engineering works for many years and is superior in both function and working efficiency, but a demand exists for remedying the following inconveniences.

First, the building frame width is not always constant in relation to, for example, the working space in the site of a construction work or a civil engineering work and at every work a suitable building frame is selected from among building frames of different widths between struts accordance with each building site. In other words, it is necessary to provide building frames of different width beforehand so as to match working spaces in various building sites. As a result, the assembling performance is restricted and it is difficult and troublesome to handle building frames in a classified state by widths. Besides, the storage place is restricted and it is uneconomical to keep such building frames in custody.

Secondly, since adjacent building frames arranged in the transverse direction are connected together through braces which cross in X shape, not only the braces are used as a frame connecting member but also they function as balustrades. However, large spaces are formed above and below the braces. Particularly, no balustrade is present at a certain height above the braces and thus safety is not ensured.

SUMMARY OF THE INVENTION

It is therefore an object of the present invention to provide a frame having versatility, superior in assembling performance, easy to be assembled and disassembled, easy to handle, and not restricted by the place for custody, as well as a structure such as prefabricated scaffolding, shoring, or support beam, which uses the said frame and is therefore not restricted its assembling performance and which is superior in both economy and safety.

In order to achieve the above-mentioned object, the frame according to the present invention comprises a strut, a first connector support member mounted at an intermediate or nearly intermediate position of the strut, a second connector support member mounted at an upper or lower position of the strut or at both upper and lower positions of the strut, one or plural lateral members secured sideways to the strut removably or rotatably, and a connector provided at an outer end of the lateral member in a vertical position corresponding to the height of the first or the second connector support member.

Further, in order to achieve the above-mentioned object, the prefabricated scaffolding according to the present invention is constituted by combining a plurality of the above frames lengthwise and crosswise.

Likewise, the shoring according to the present invention is constituted by combining a plurality of the above frames lengthwise and crosswise.

Likewise, the support beam according to the present invention is constituted by combining a plurality of the above frames lengthwise and crosswise.

DESCRIPTION OF THE PREFERRED EMBODIMENTS

The following description is now provided about frames embodying the present invention, as well as prefabricated scaffoldings, shorings and support beam using the frames, and further about auxiliary members used as necessary.

Frames according to the present invention are basically classified into four groups.

Figure 54:
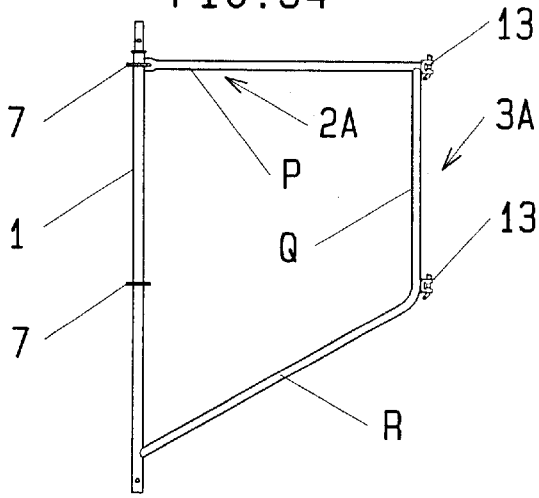
FIG. 54 is a front view of a frame according to a still further embodiment of the present invention.
Figure 55A:
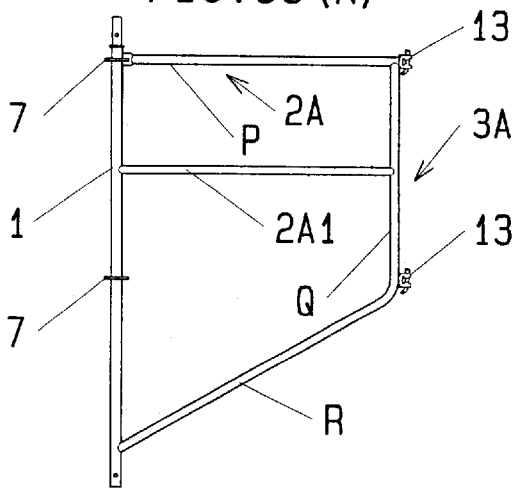
FIGS. 55(A) and (B) are front views of frames according to still further embodiments of the present invention.
Figure 55B:
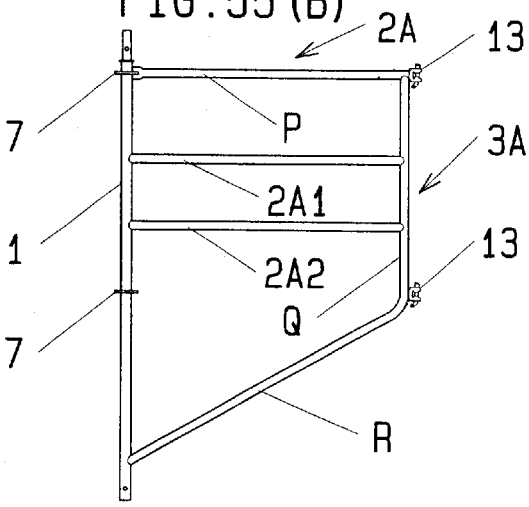
Figure 56:
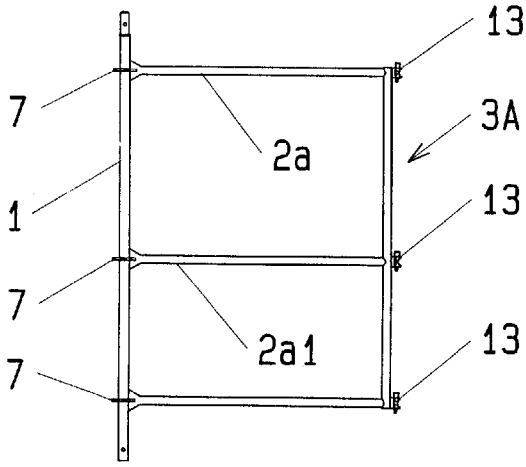
FIG. 56 is a front view of a frame according to a still further embodiment of the present invention.

The first group of frames are illustrated in FIGS. 1 to 47 and FIGS. 48 to 52, the second group of frames are illustrated in FIGS. 54 to 56, the third group of frames are illustrated in FIGS. 57 to 67, and the fourth group of frames are illustrated in FIGS. 68 to 83.

Figure 48:
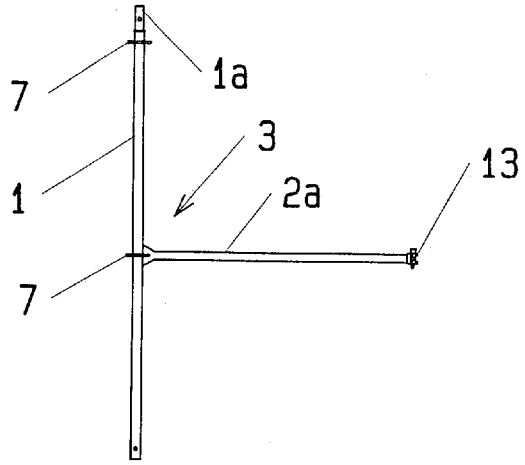
FIG. 48 is a front view of a frame according to a still further embodiment of the present invention.
Figure 49:
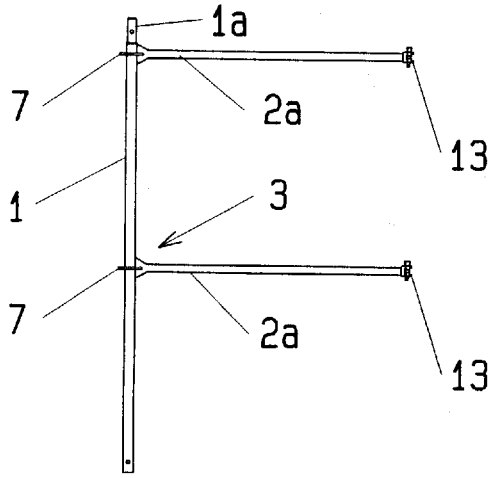
FIG. 49 is a plan view of a frame according to a still further embodiment of the present invention.

The frames belonging to the first group are each basically constituted by a frame 3, as shown in FIG. 48 for example. The frame 3 comprises a support post 1, a flange 7 as a first connector support member provided at an intermediate position or a nearly intermediate position of the support post 1, a flange 7 as a second connector support member provided at an upper or lower position or at both upper and lower positions of the support post 1, a horizontal member 2*a* as a lateral member disposed sideways of the support post 1, and a metallic piece 13 as a connector provided at an outer end of the horizontal member 2*a* correspondingly to the flange 7 as the first or the second connector support member. The metallic piece 13 comprises a bifurcated shoe and a wedge inserted into the shoe. But no limitation is made thereto.

The frames belonging to the second group are each basically constituted by a trapezoidal frame 3A, as shown in FIG. 54 for example. The trapezoidal frame 3A comprises a support post 1, flanges 7, 7 as first and second connector support members provided on the support post 1, a frame 2A as a lateral member disposed sideways of the support post 1, and metallic pieces 13 as connectors mounted at outer end positions of the frame 2A in a corresponding relation respectively to the flanges 7, 7.

Figure 57:
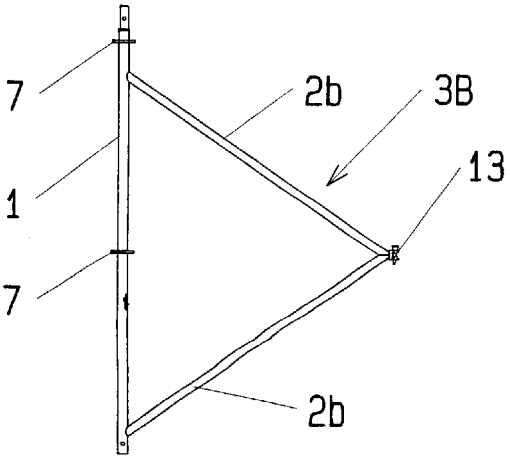
FIG. 57 is a front view of a frame according to a still further embodiment of the present invention.

The frames belonging to the third group are each basically constituted by a frame 3B which is in the shape of an isosceles triangle, as shown in FIG. 57 for example. The frame 3B comprises a support post 1, flanges 7, 7 as first and second connector support members provided on the support post 1, a V-shaped isosceles frame 2B as a lateral member disposed sideways of the support post 1, and a metallic piece 13 as a connector mounted at an outer end of the frame 2B correspondingly to one of the flanges 7.

Figure 68:
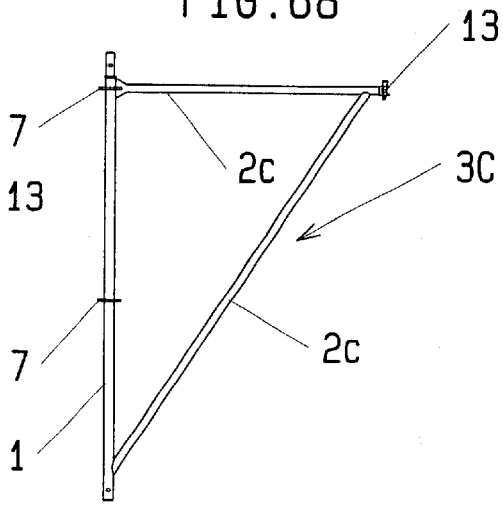
FIG. 68 is a front view of a frame according to a still further embodiment of the present invention.

The frames belonging to the fourth group are each basically constituted by a frame 3C which is in the shape of a right-angled triangle, as shown in FIG. 68. The frame 3C comprises a support post 1, flanges 7, 7 as first and second connector support members mounted on the support post 1, a V-shaped frame 2C which is disposed sideways of the support post 1 and which comprises a horizontal member as a lateral member and a diagonal member, and a metallic piece 13 as a connector mounted at an outer end of the V-shaped frame 2C correspondingly to one of the flanges 7, 7.

Now, with reference to FIGS. 1 to 47, a description will be given of a prefabricated scaffolding A assembled by using the frame 3 which belongs to the first group. In the embodiment illustrated in FIG. 1, the frame 3 comprises two support posts 1, 1, a balustrade 2 mounted between the support posts 1, 1, and a horizontal member 4 as a lateral member secured to one support post 1. A large number of such frames 3 are disposed alternately in the lateral direction, and two adjacent frames 3, 3 are connected together through an intermediate balustrade 2*a*. Flanges 7 are mounted on each support post 1 at intermediate and upper positions, respectively, and horizontal members 4, 4 are connected respectively to the flanges 7, 7 on one support post. The balustrade 2*a* may be independent or may be secured as a lateral member to the support post 1.

A more detailed description will be given below.

Figure 1:
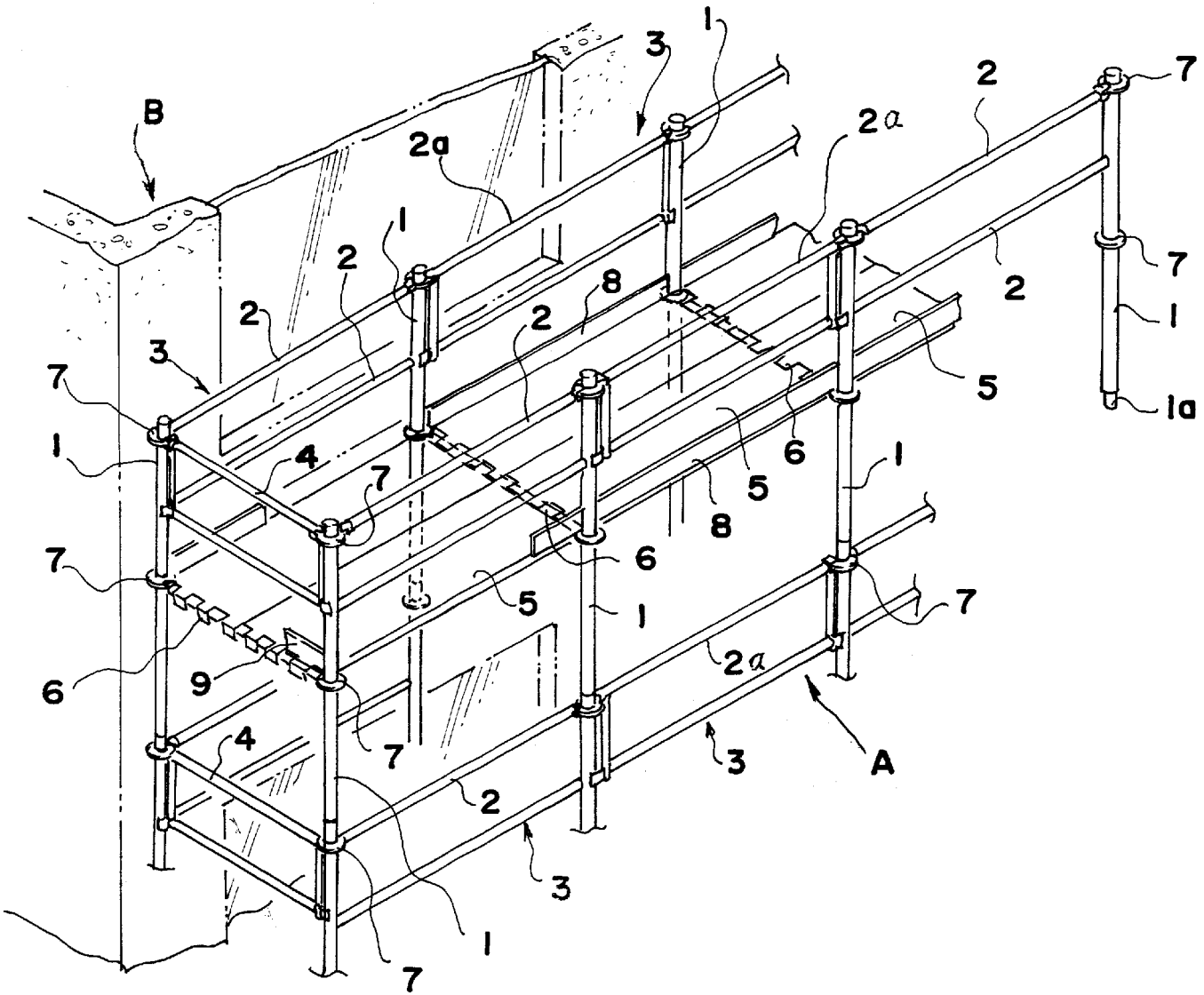
FIG. 1 is a partially cut-away perspective view of a prefabricated scaffolding using frames according to an embodiment of the present invention.
Figure 2:
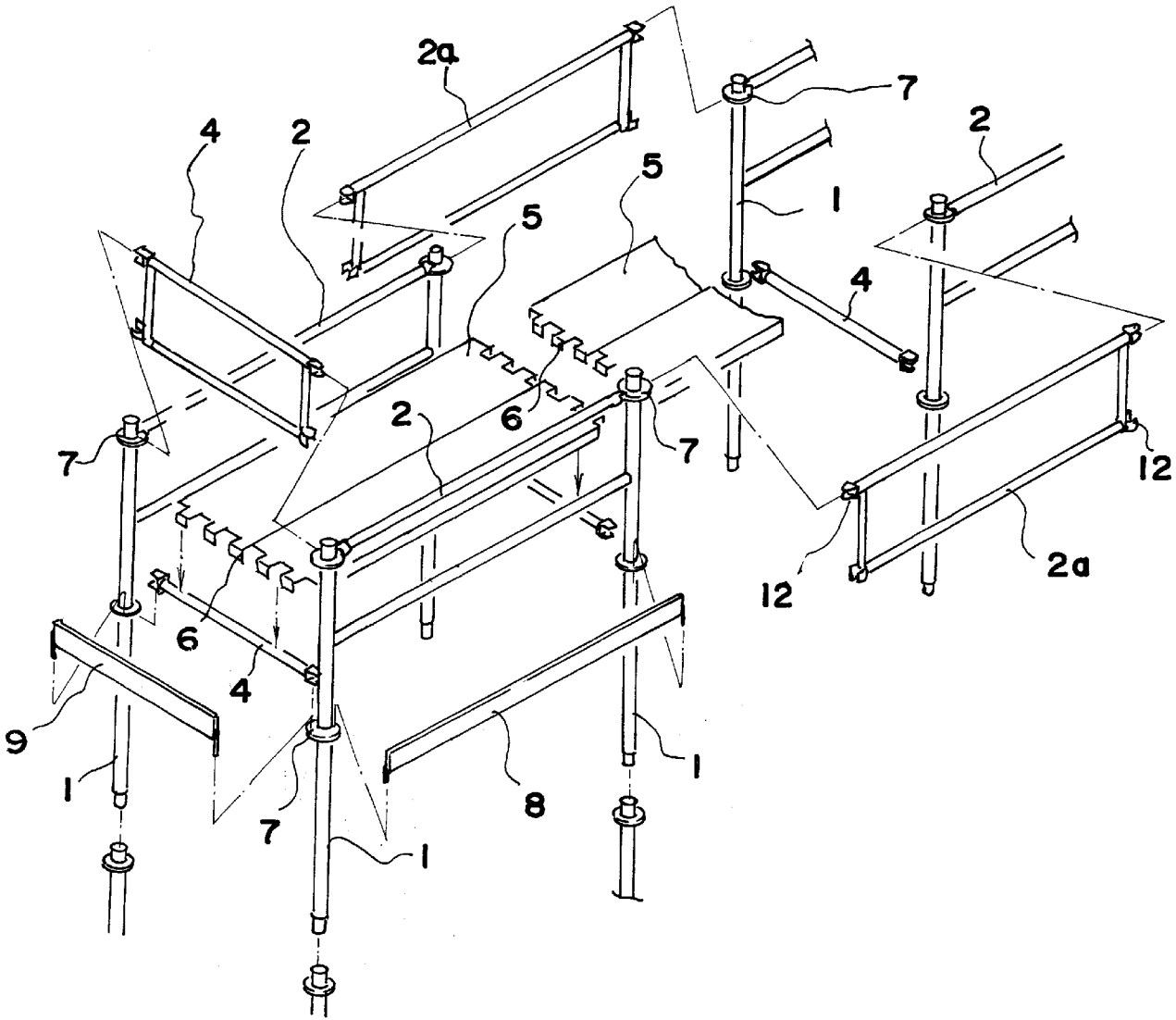
FIG. 2 is an exploded perspective view thereof.
Figure 3:
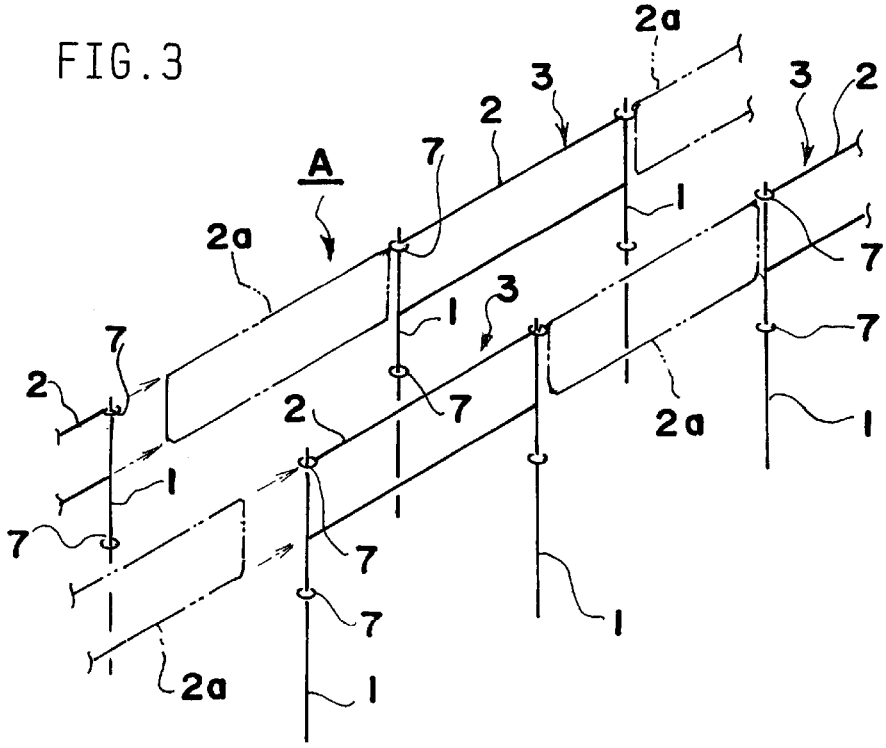
FIG. 3 is a schematic perspective view showing an arranged state of the frames according to an embodiment of the present invention.

In the prefabricated scaffolding A, as shown in FIGS. 1 to 3, a plurality of frames 3 are disposed upright in the lateral direction and at two rows in front and in the rear, the frames 3 each comprising two parallel, upright support posts 1, 1, a balustrade 2 mounted laterally between the support posts 1, 1 and a horizontal member 4 as a lateral member secured to one support post. The opposed front and rear support posts 1, 1 are interconnected through the horizontal member 4 as a lateral member secured to one support post 1, while the support posts 1, 1 adjacent to each other in the lateral direction are interconnected through two horizontal balustrades 2*a* as lateral members secured removably to the right-hand support post 1 in FIG. 1. Further, one or plural scaffolding boards 5 are disposed in series in the lateral direction between the front and rear frames 3, 3, and both end portions of each scaffolding board are removably engaged through engaging portions 6 with the horizontal members 4 corresponding to the said end portions. On the outer periphery of each support post 1 are mounted perforated flanges 7 as connector support members at upper, intermediate and lower positions.

The balustrade 2 comprises two horizontal members which are an upper horizontal member mounted removably between the upper flanges 7, 7 and a lower horizontal member mounted between adjacent support posts 1, 1, provided the balustrade 2 may be constituted by only the upper or the lower horizontal member.

Likewise, horizontal members 4 mounted between the front and rear support posts 1, 1 are removably connected at both ends thereof respectively to the upper, intermediate and lower flanges 7, provided there may be only one horizontal member or may be two upper and lower horizontal members as shown in the figures.

Although the balustrades 2*a* are connected to the support posts 1, 1 through flanges 7 as connector support members, there may be used other connector support members such as, for example, pins.

Scaffolding boards 5 are arranged in series in the lateral direction and plural such boards are arranged in the front and rear direction, provided a single board may be used in the front and rear direction if the board is wide in the same direction.

At both ends of each scaffolding board 5 are formed engaging portions 6 of C- or L-shaped section. Through the engaging portions 6 the scaffolding board 5 is connected removably to the intermediate or lower horizontal members 4. In the scaffolding boards 5, 5 adjacent to each other in the lateral direction, the right-hand engaging portion 6 of the left-hand scaffolding board 5 and the left-hand engaging portion 6 of the right-hand scaffolding board 5 are formed in an alternate manner.

Frames 3, 3 adjacent to each other in the lateral direction are connected together through the balustrade 2*a* mounted removably between the upper flanges 7, 7. The balustrade 2*a* comprises two upper and lower horizontal members, right and left vertical support rods connected to end portions of the two horizontal members, and bifurcated metallic pieces 12 provided at both ends of each horizontal member. The two horizontal members may be substituted by a single horizontal member. Further, one or plural baseboards 8 are disposed upright and in series laterally on each of both front and rear sides of the scaffolding boards 5. End portions of each baseboard 8 are connected to holes of the flanges 7 removably through pins.

At each of both right and left ends of the prefabricated scaffolding A is disposed a baseboard 9 upright in the front and rear direction, which is connected in the same manner as above.

The following method is adopted for disposing the prefabricated scaffolding A in an opposed relation to a structure B such as a building. As shown in FIG. 3, a large number of frames 3 are arranged upright laterally in two front and rear rows. In this case, frames 3 adjacent to each other in the lateral direction are connected together through the balustrade 2*a* secured removably to one support post 1, while frames 3, 3 opposed to each other in the front and rear direction are connected together through the horizontal members 4 secured to one support post 1. In this way there is formed a scaffolding frame which is in the shape of rectangular parallelepiped, in which are then mounted scaffolding boards 5 at intermediate positions to complete the scaffolding board.

It is optional whether the front and rear frames 3, 3 are to be arranged at symmetric positions or arranged in an alternate fashion. In the latter case, it is the balustrade 2*a* that is opposed on the rear side to the front frame 3, and a horizontal member is mounted between the right-hand support post 1 of the front frame 3 and the left-hand support post 1 of the rear frame 3.

Figure 5:
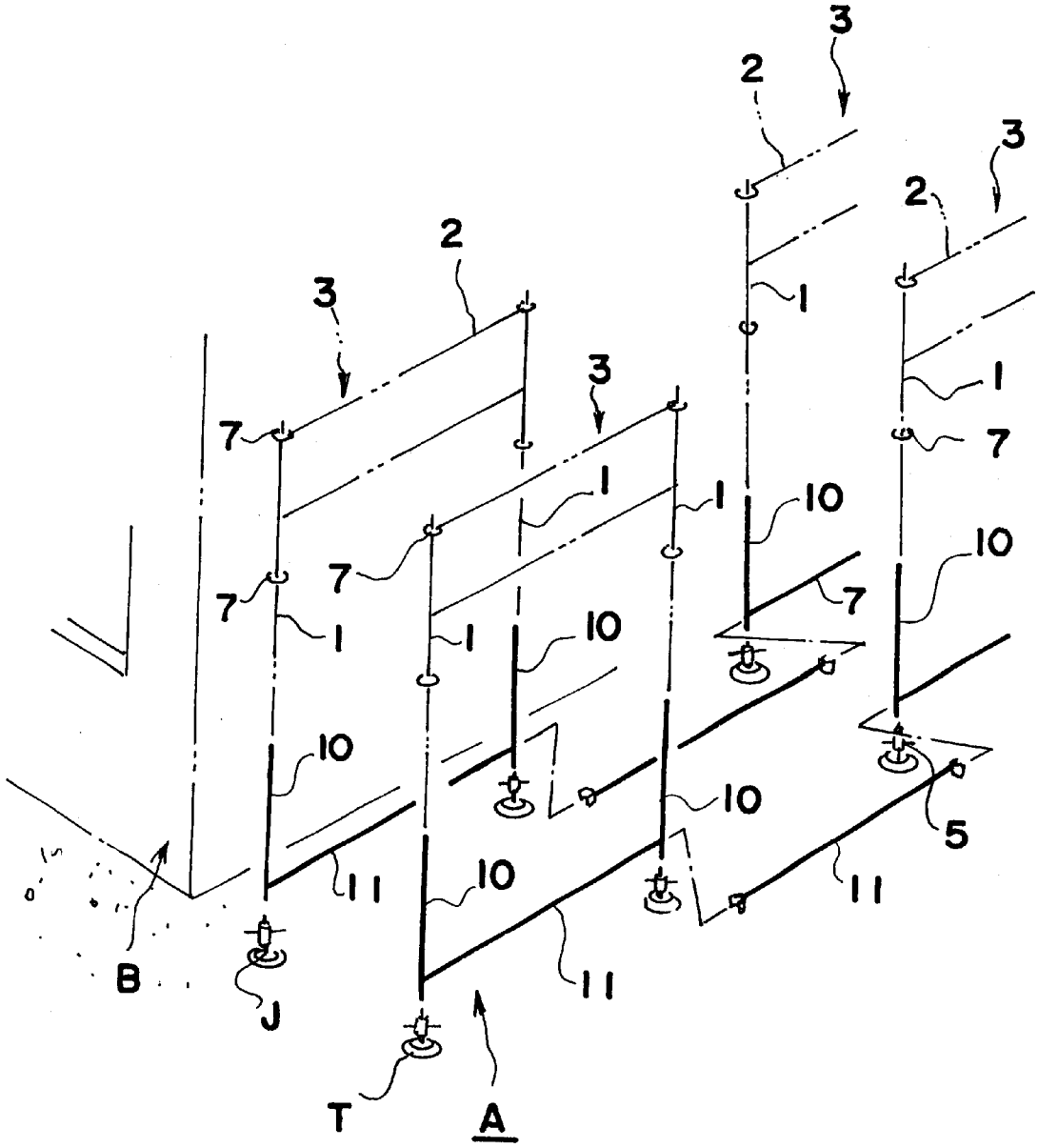
FIG. 5 is a schematic perspective view showing an arranged state of jacks and support struts.

The support posts 1 may be raised directly on the ground. Alternatively, as shown in FIG. 5, support rods 10 may be raised on the ground through jacks J and the support posts 1 which constitute each frame 3 may be removably inserted respectively into the upper ends of the support rods 10.

The support rods 10 may be arranged one by one, or a set of two support connected through a horizontal support bar 11 may be raised on the ground through jacks. Further, a plurality of frames 3 may be mounted vertically in plural stages. In this case, the upper support post 1 is inserted into an upper-end hole of the lower support post 1 through a spigot portion 1*a* of a small diameter.

Figure 4:
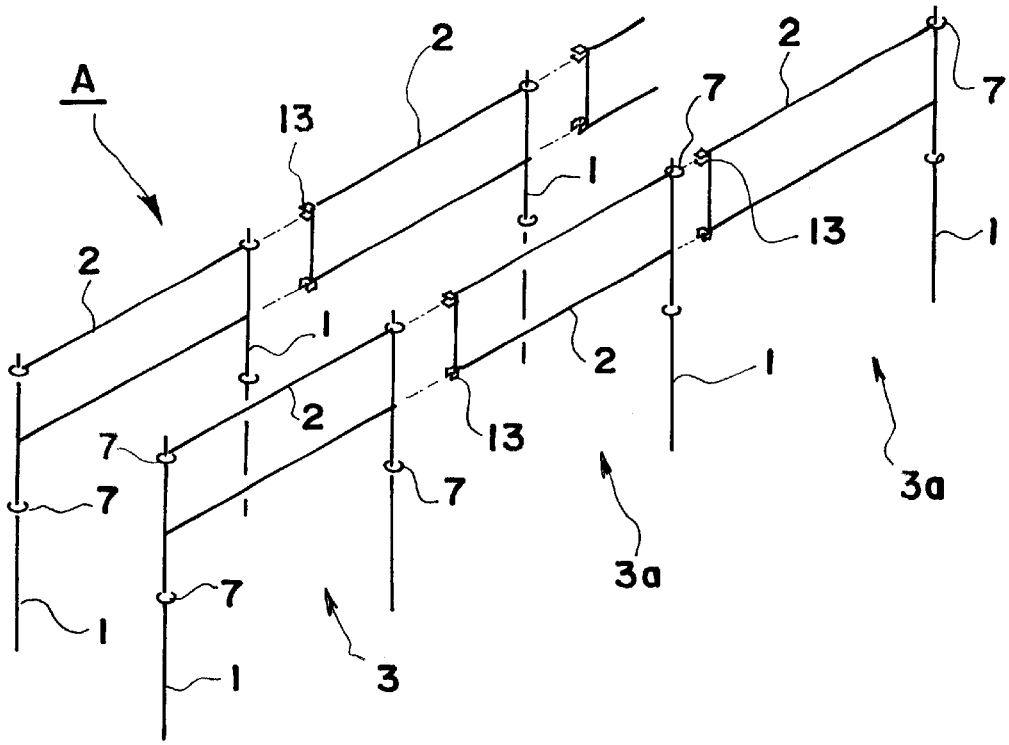
FIG. 4 is a perspective view showing an arranged state of frames according to another embodiment of the present invention.

FIG. 4 schematically illustrates a prefabricated scaffolding according to another embodiment of the present invention. In this prefabricated scaffolding, indicated at A, a frame 3*a* comprises one support post 1 and a balustrade 2 as a lateral member mounted laterally to the support post 1. Plural such frames 3*a* are laterally arranged upright in two front and rear rows. Front and rear support posts 1 opposed to each other are interconnected detachably through the same horizontal members 4 as in FIG. 1, and support posts 1, 1 adjacent to each other laterally are interconnected through the balustrade 2 of one support post 1. Further, one or plural scaffolding boards 5 are laterally arranged in series between the front and rear frames 3, 3, and both end portions of each scaffolding board 5 are engaged detachably with the associated horizontal members 4.

At the leftmost end position of the prefabricated scaffolding A is raised one support post, or as illustrated in the figure, the same frame as the frame 3 in FIG. 1 is raised on the ground.

In the case where one frame 3*a* comprising a single support post 1 and the balustrade 2 mounted at the upper portion of the support post, an end portion of the balustrade 2 is connected removably to the support post of the frame 3*a* adjacent laterally to the one frame. The balustrade 2 comprises one or two parallel horizontal members, and one end of the balustrade 2 is connected to the support post 1 through a flange 7 or by welding or through a pin or the like. At the opposite end of the balustrade 2 is formed a metallic pieces 13 as a connector, which is connected to a flange 7 on the other adjacent support post 1 side.

Figure 6:
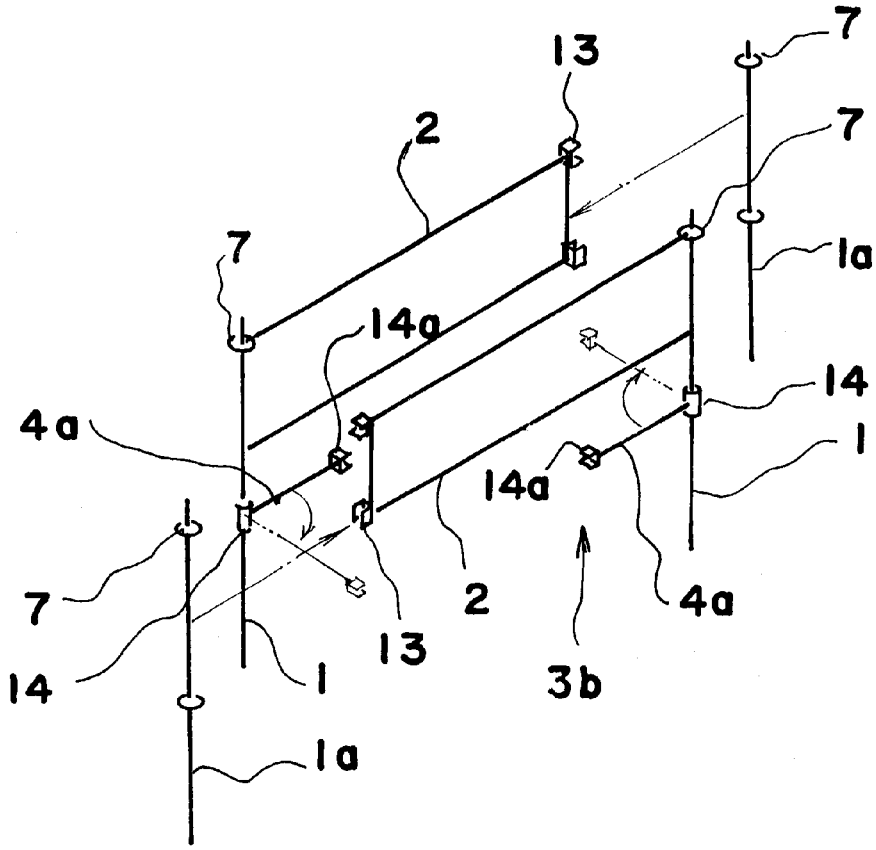
FIG. 6 is an exploded, schematic perspective view of a frame according to a further embodiment of the present invention.
Figure 7:
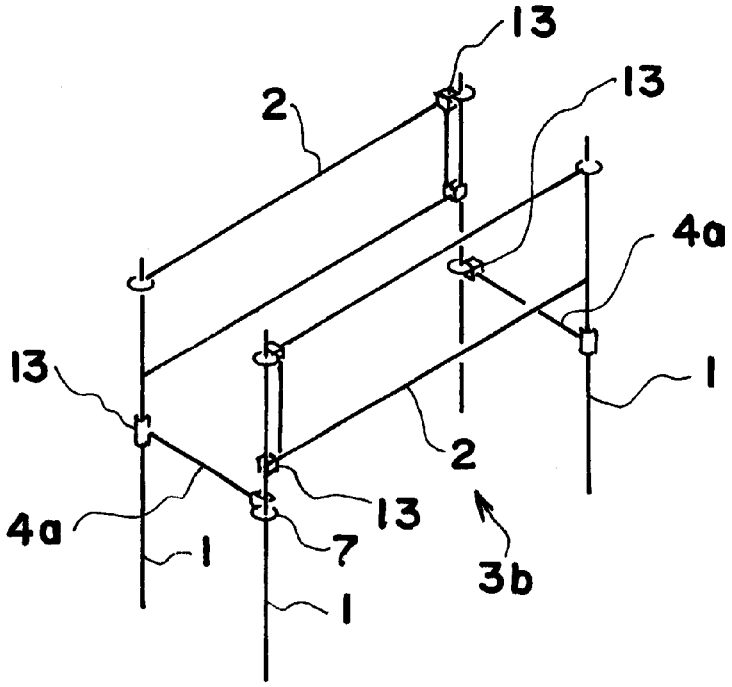
FIG. 7 is a perspective view showing an assembled state thereof.
Figure 8:
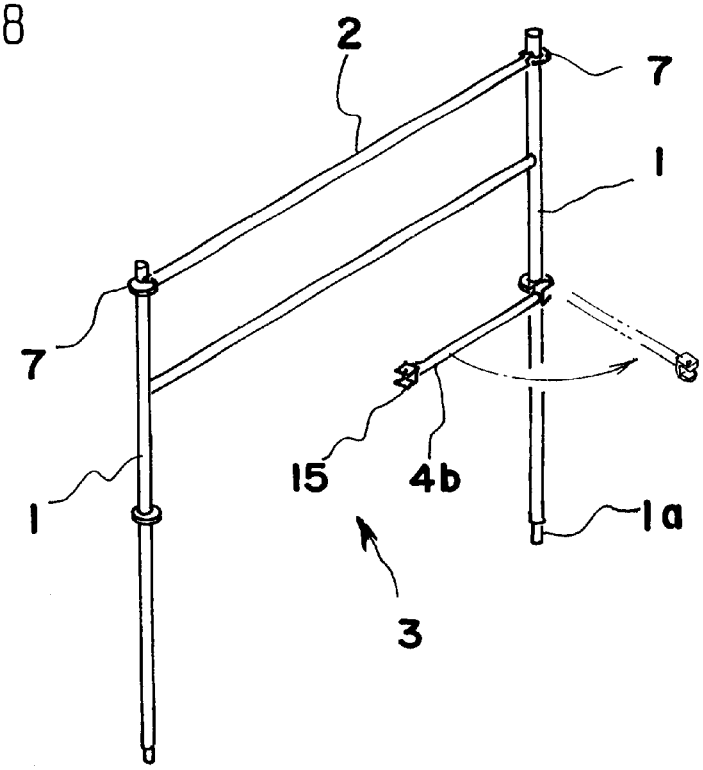
FIG. 8 is a perspective view of a frame according to a still further embodiment of the present invention.
Figure 9:
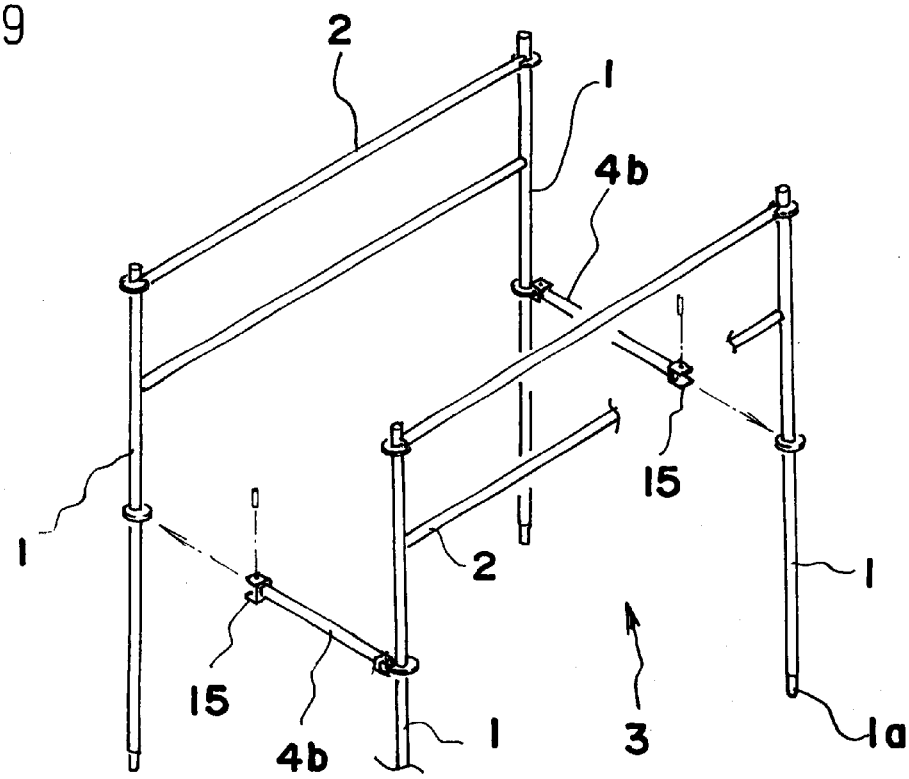
FIG. 9 is a perspective view showing an assembling sequence using the frame of FIG. 8.
Figure 10:
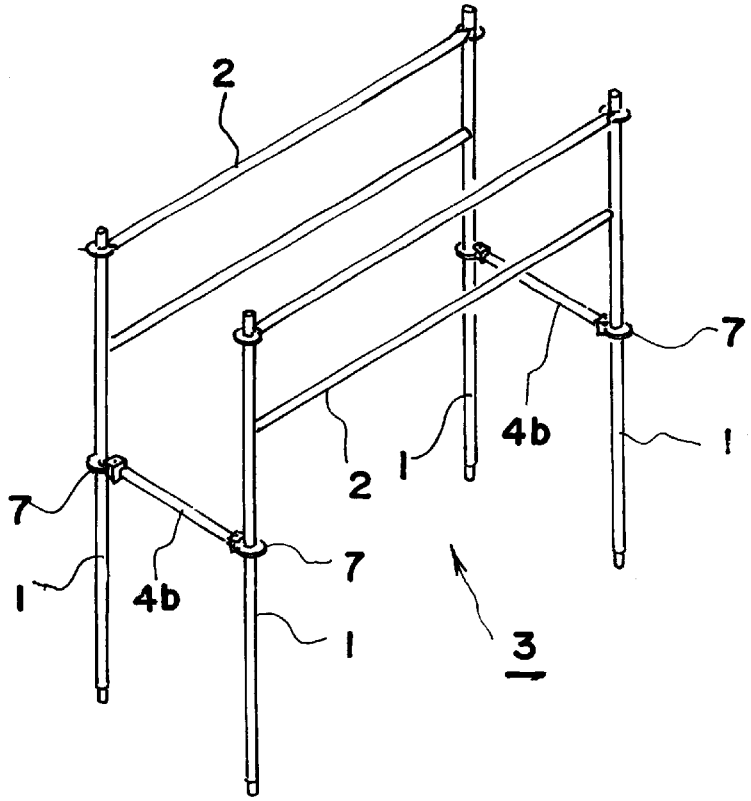
FIG. 10 is a perspective view showing an assembled state of the frame of FIG. 8.

Other structural points and assembling method are the same as in FIGS. 1 and 5. FIGS. 6 and 7 illustrate a frame according to a further embodiment of the present invention.

In this frame, which is substantially the same as the frame shown in FIG. 4, a horizontal member 4*a* as a lateral member provided at an end portion thereof with a metallic piece 14*a* as a connector is connected rotatably to a support post 1.

Like the frame shown in FIG. 4, the frame of this embodiment, indicated at 3*b*, comprises one support post 1, a balustrade 2 which comprises two parallel horizontal members mounted integrally at the upper portion of the support post 1, and metallic pieces 13 provided at one end of the balustrade 2. Although the front and rear frames 3*b*, 3*b* face in opposite directions, they may face in the same direction.

Adjacent the front and rear frames 3*b*, 3*b* are respectively raised one support posts 1*a*, 1*a* provided with flanges 7, and metallic pieces 13, 13 of the front and rear balustrades 2, 2 are removably connected respectively to the support posts 1*a*, 1*a*.

Base ends of the horizontal members 4*a*, 4*a* are connected rotatably to approximately intermediate positions of the support posts 1, 1 through sockets 14, 14. When frames 3*b*, 3*b* are arranged in front and rear relation opposedly to each other, the horizontal member 4*a* from one support post 1 is connected to the other support post 1 opposed to the one support post through the intermediate flange 7 and metallic piece 14*a*. As in FIG. 1, a scaffolding board 5 is mounted removably on the horizontal member 4*a*.

Figure 11:
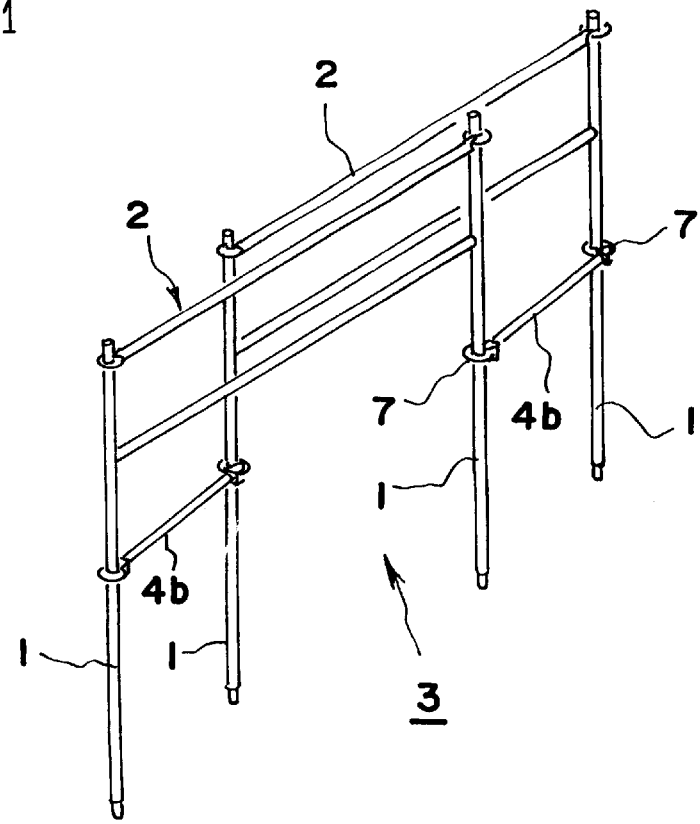
FIG. 11 is a perspective view showing a folded state from the state of FIG. 10.

FIGS. 8 to 11 illustrate a frame according to a still further embodiment of the present invention. In this embodiment, the frame 3 shown in FIG. 1 is rotatably provided with a horizontal member 4*b* as a lateral member which has a metallic piece 15. More specifically, the horizontal member 4*b* is connected rotatably to an approximately intermediate position of the support post 1 directly or through a socket or a flange 7. When a pair of frames 3 are arranged in front and in the rear, the horizontal member 4*b* from one support post 1 is connected to the other support post 1 removably through the flange 7. Other structural points and assembling method are the same as in FIG. 1. In the case where a pair of frames 3 are connected together in front and rear relation to each other through horizontal members 4*b*, there is obtained a prefabricated scaffolding A assembled in the shape of a parallelogram in plan centered at the base ends of the horizontal members 4*b*, and the entire scaffolding frame can be folded while rotating in a compact manner, as shown in FIG. 11.

Figure 12:
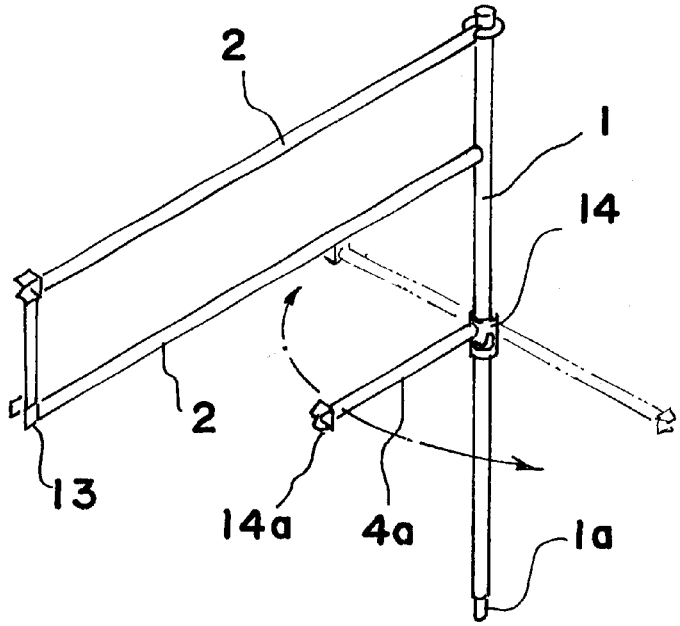
FIG. 12 is a perspective view of a frame according to a still further embodiment of the present invention.
Figure 13:
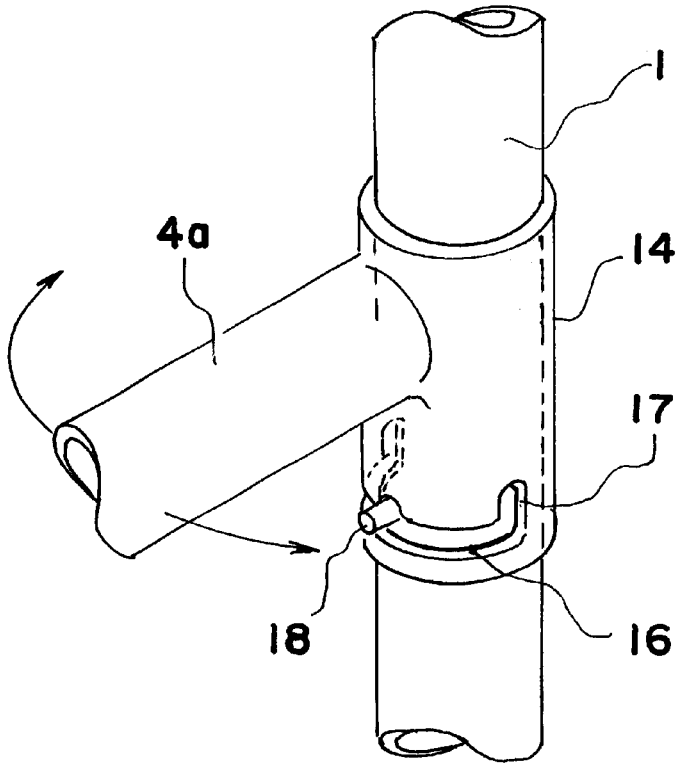
FIG. 13 is a partially enlarged perspective view of FIG. 12.

FIGS. 12 and 13 illustrate a still further embodiment of the present invention, which is a concrete mode of embodiment of the horizontal member 4*a* shown in FIGS. 6 and 7.

In this embodiment, a pipe-like socket 14 is rotatably fitted on a support post 1, a horizontal member 4*a* as a lateral member connected integrally to the body portion of the socket 14 is constituted by a pipe, and a metallic piece 14*a* as a connector, which is a bifurcated shoe, is integrally formed at an end portion of the pipe. The socket 14 is formed with a horizontal guide slot 16 and vertically guide slots 17, and a stopper pin 18 projecting from the support post 1 is fitted in the guide slots 16 and 17. When the horizontal member 4*a* turns in the horizontal direction through the horizontal guide slot 16 and the stopper pin 18 comes to be fitted in the vertical guide slot 17, the horizontal member 4*a* faces in the front and rear direction and is held in place. Other structural points are the same as in FIG. 6.

FIGS. 14 to 21 illustrate frames 3 according to still further embodiments of the present invention, which frames each comprise one support post 1, flanges 7 as connector support members formed on the support post 1, a balustrade 2 as a lateral member mounted to the support post 1, and a metallic piece 13 as a connector formed at an outer end of the balustrade 2. The frames 3 of these embodiments are used in assembling the prefabricated scaffoldings A shown in FIGS. 4 and 6.

Figure 14:
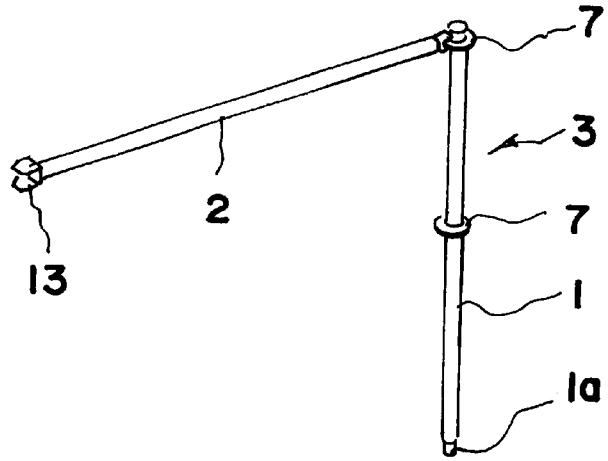
FIG. 14 is a perspective view of a frame according to a still further embodiment of the present invention.

The frame shown in FIG. 14 comprises one support post 1, one balustrade 2 as a lateral member connected at a base end thereof to a flange 7 which is formed at the upper portion of the support post 1, and a metallic piece 13 as a connector which is formed at an outer end of the balustrade 2 and which is constituted by a bifurcated shoe.

Figure 15:
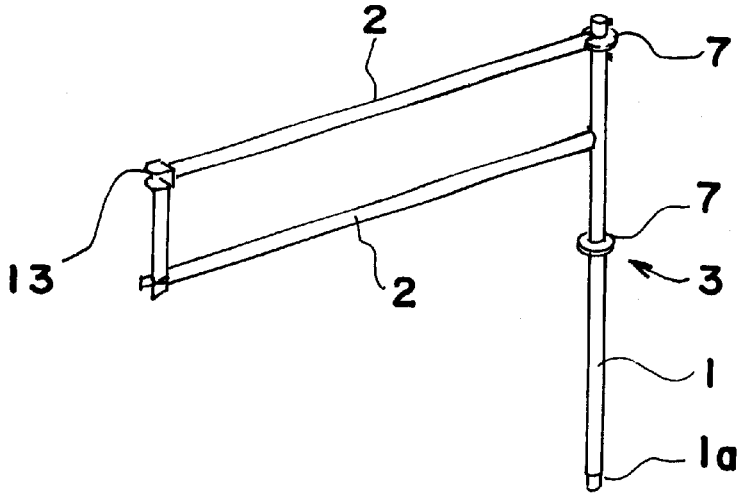
FIG. 15 is a perspective view of a frame according to a still further embodiment of the present invention.

The frame 3 shown in FIG. 15 has two parallel, upper and lower balustrades 2, 2 provided on the support post 1 shown in FIG. 14, with metallic pieces 13, 13 being provided respectively at outer ends of the balustrades 2, 2.

Figure 16:
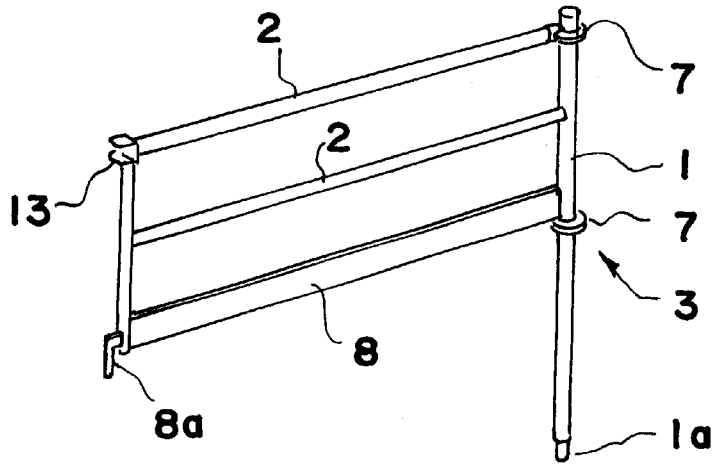
FIG. 16 is a perspective view of a frame according to a still further embodiment of the present invention.

The frame 3 shown in FIG. 16 has two balustrades 2, 2 and a baseboard 8 located below the balustrades. Abase end of the baseboard 8 is inserted into a hole of a flange 7 through a pin. Also at the opposite end of the baseboard 8 is provided an insertion pin 8*a*, which is inserted into a hole of a flange 7 formed on another support post 1 opposed to the support post of this side.

In the frame 3 shown in FIG. 17(A), a reinforcing brace 19 serving also as a diagonal balustrade is mounted between the support post 1 and the balustrade 2 both shown in FIG. 14. In the frame shown in FIG. 17(B), base ends of horizontal members 2*d* and 2*e* as lateral members are secured to respectively to two upper and lower flanges 7, 7, metallic pieces 13, 13 are provided respectively at outer ends of the horizontal members, and diagonal braces 2*f* and 2*g* are mounted between the horizontal members 2*d*, 2*e* and a side portion of the support post 1.

Figure 18:
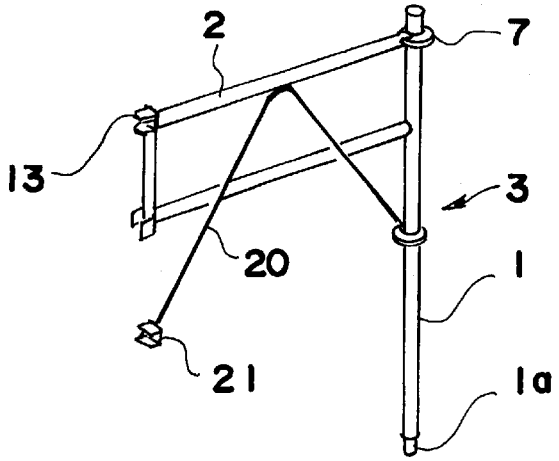
FIG. 18 is a perspective view of a frame according to a still further embodiment of the present invention.

In the frame 3 shown in FIG. 18, an inverted V-shaped reinforcing brace 20 also serving as a balustrade is secured to both support post 1 and balustrades 2 shown in FIG. 15, and an end portion of the brace 20 is connected through a metallic piece 21 to another support post 1 opposed to the support post of this side.

Figure 17:
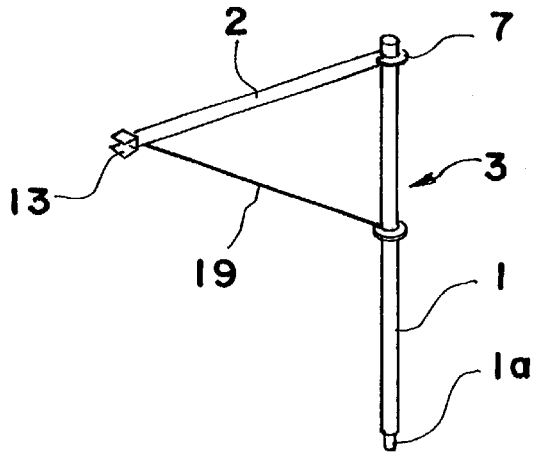
FIGS. 17(A) and (B) are a perspective view and a front view, respectively, of frames according to still further embodiments of the present invention.
Figure 17:
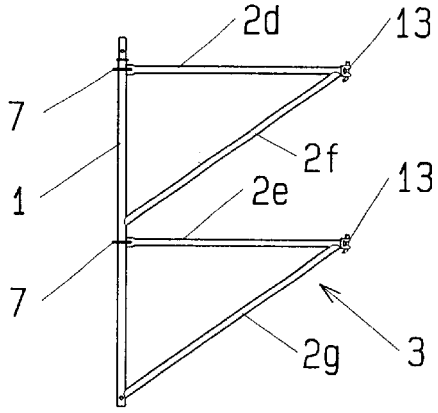
Figure 19:
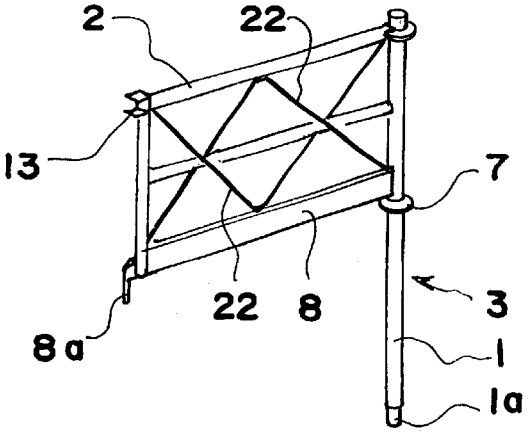
FIG. 19 is a perspective view of a frame according to a still further embodiment of the present invention.

In the frame 3 shown in FIG. 19, V-shaped or wavy braces 22, 22 serving also as balustrades are secured to the balustrades 2 shown in FIG. 17.

Figure 20:
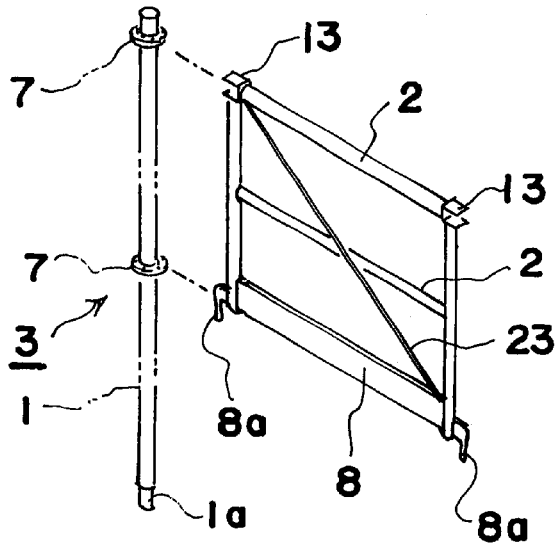
FIG. 20 is a perspective view of a frame according to a still further embodiment of the present invention.

According to the frame 3 shown in FIG. 20, a balustrade 2 having metallic pieces 13, 13, a baseboard 8 having engaging metallic pieces 8*a*, 8*a*, are integrally combined together and this integral combination is connected detachably to upper and lower flanges 7, 7 on a support post 1.

Figure 21:
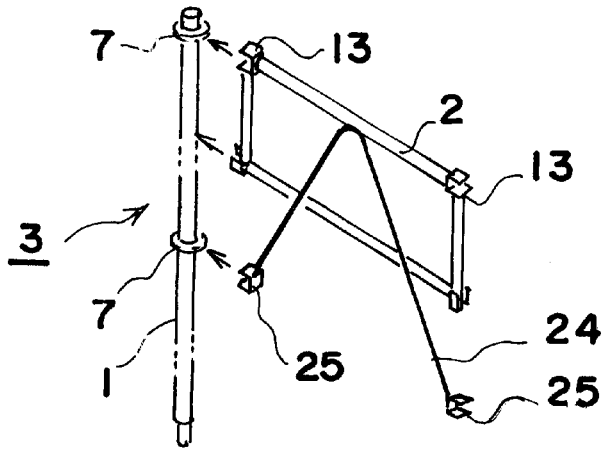
FIG. 21 is a perspective view of a frame according to a still further embodiment of the present invention.

According to the frame 3 shown in FIG. 21, a balustrade 2 having metallic pieces 13, 13 and an inverted V-shaped brace 24 having metallic pieces 25, 25 are combined together and this combined unit is connected to flanges 7, 7 of a support post 1 detachably through metallic pieces 13 and 25.

Figure 22:
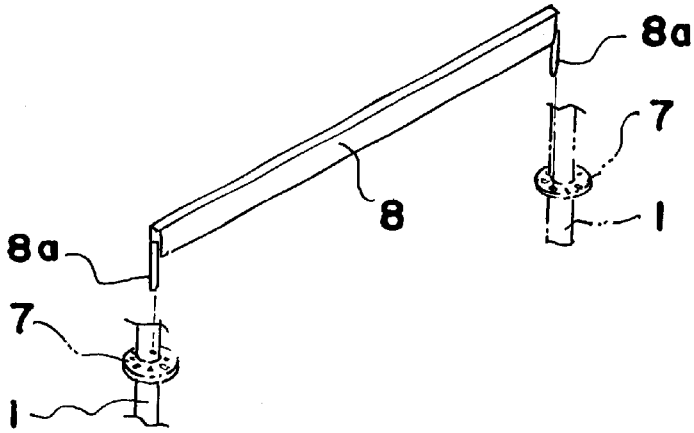
FIG. 22 is an exploded perspective view showing a working mode of a baseboard.

FIG. 22 illustrates a concrete mode of embodiment of the baseboard 8 which has already been explained in connection with FIG. 1. Pins 8*a*, 8*a* are integrally provided at both ends of a plate-like baseboard 8 having a predetermined certain width and are inserted and fixed into holes of flanges 7 formed on opposed, front and rear, or right and left, support posts 1, 1.

FIGS. 23 to 34 illustrate support posts according to still further embodiments of the present invention. The support posts, which are each used in assembling the frame 3 of the prefabricated scaffolding A shown in FIG. 1, are each basically constituted by a pair of support posts 1, 1 and a balustrade 2 mounted between the support posts. In the embodiments being considered, a horizontal member or members are mounted between the support posts 1.

Figure 23:
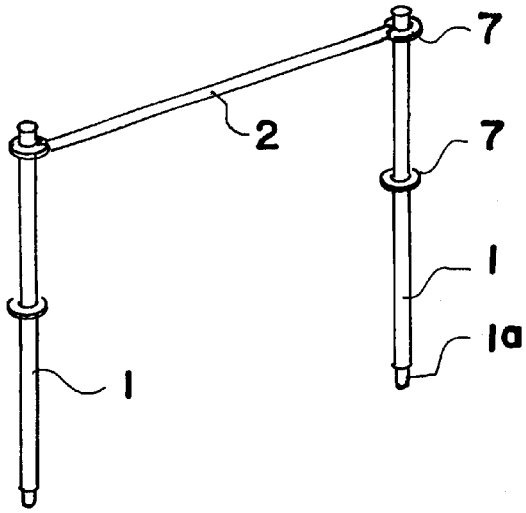
FIG. 23 is a perspective view of a frame according to a still further embodiment of the present invention.
Figure 24:
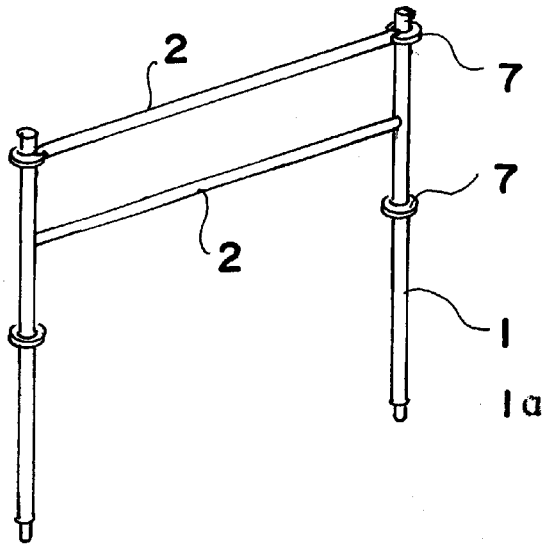
FIG. 24 is a perspective view of a support post and a balustrade according to a still further embodiment of the present invention.

In the frame 3 shown in FIG. 23, one horizontal balustrade 2 is mounted between two support posts 1, 1 through flanges 7, 7, while the frame 3 shown in FIG. 24 is provided with two parallel, upper and lower balustrades 2. In the frame 3 shown in FIG. 25, a baseboard 8 is connected to support posts 1, 1 through flanges 7, 7 and at a position below the balustrades 2 shown in FIG. 24.

Figure 25:
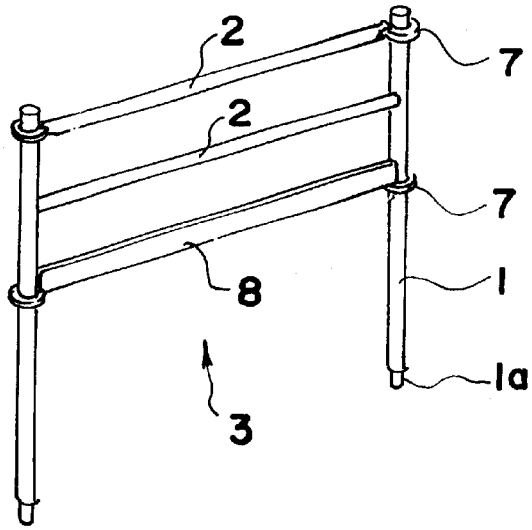
FIG. 25 is a perspective view of a support post and a balustrade according to a still further embodiment of the present invention.
Figure 26:
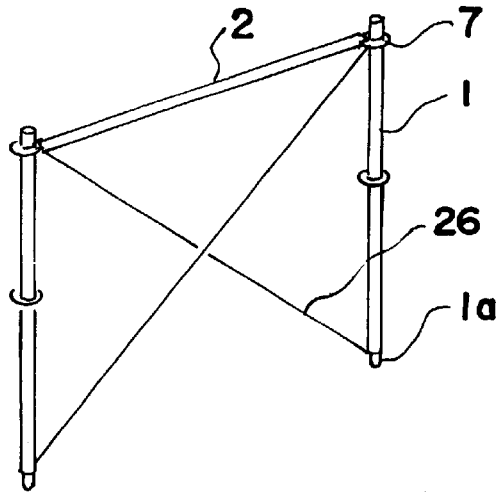
FIG. 26 is a perspective view of a support post and a balustrade according to a still further embodiment of the present invention.
Figure 27:
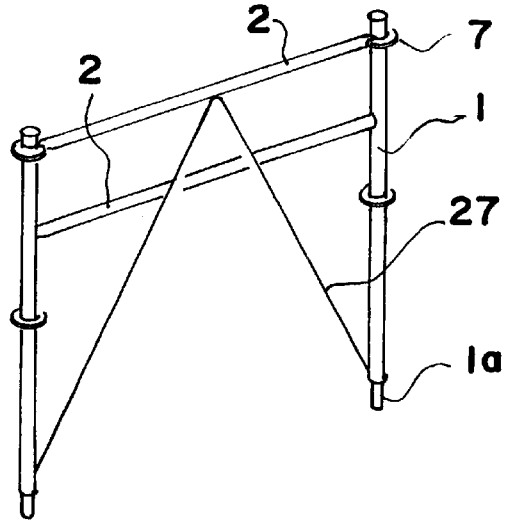
FIG. 27 is a perspective view of a support post and a balustrade according to a still further embodiment of the present invention.
Figure 28:
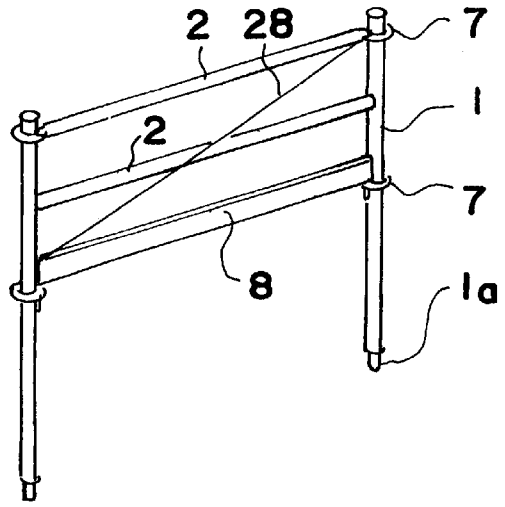
FIG. 28 is a perspective view of a support post and a balustrade according to a still further embodiment of the present invention.

The frames 3 shown in FIGS. 26, 27 and 28 are respectively provided with braces 26, 27 and 28 which serve also as balustrades and which are secured respectively to the balustrades 2 shown in FIGS. 23, 24 and 25.

Figure 29:
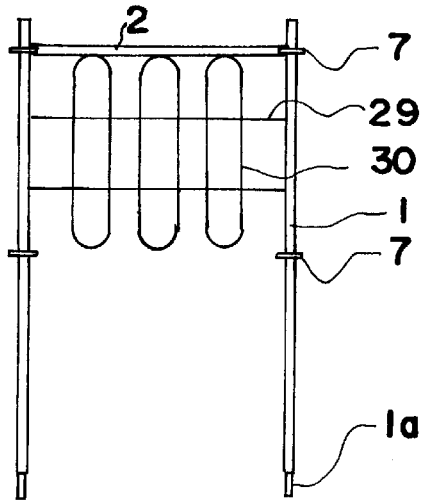
FIG. 29 is a front view of a support post and a balustrade according to a still further embodiment of the present invention.
Figure 30:
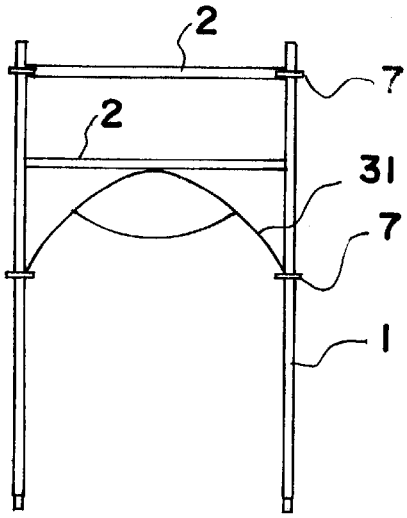
FIG. 30 is a front view of a support post and a balustrade according to a still further embodiment of the present invention.
Figure 31:
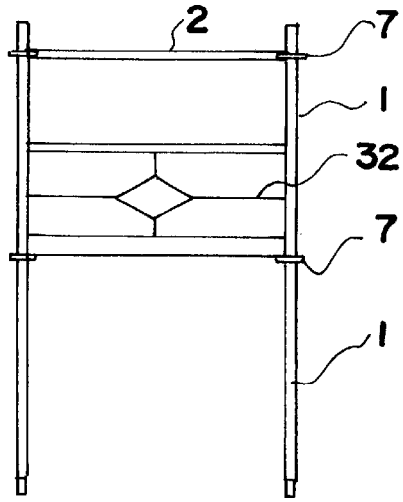
FIG. 31 is a front view of a support post and a balustrade according to a still further embodiment of the present invention.

Also in the frames shown in FIGS. 29, 30 and 31, reinforcing frame members 29, 30, 31 and 32 serving also as balustrades are mounted outside the balustrades 2.

Figure 32:
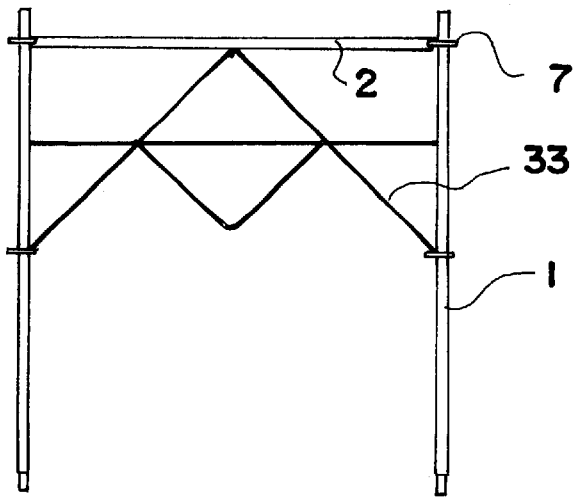
FIG. 32 is a front view of a support post and a balustrade according to a still further embodiment of the present invention.
Figure 33:
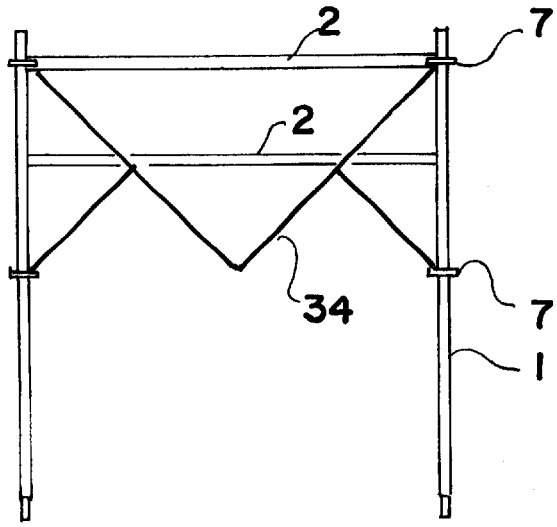
FIG. 33 is a front view of a support post and a balustrade according to a still further embodiment of the present invention.
Figure 34:
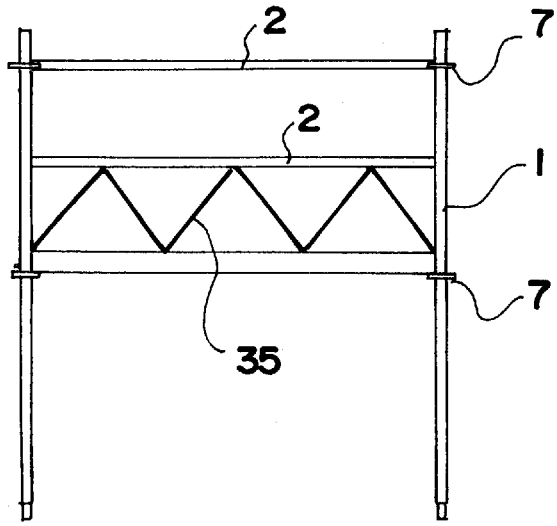
FIG. 34 is a front view of a support post and a balustrade according to a still further embodiment of the present invention.

Likewise, in the frames 3 shown in FIGS. 32, 33 and 34, braces 33, 34 and 35 of an inverted V or wavy shape and serving also as balustrades are mounted between support posts 1, in addition to the balustrade or balustrades 2.

A FIGS. 35 to 40 illustrate horizontal members 4 according to still further embodiments of the present invention, which are used in assembling the prefabricated scaffolding A shown in FIG. 1.

Figure 35:
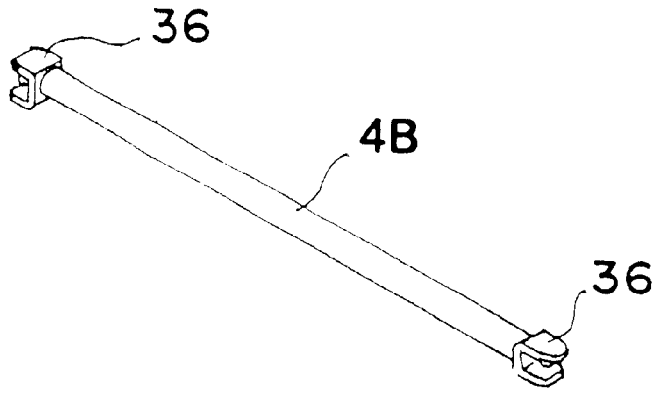
FIG. 35 is a perspective view of a horizontal member according to a still further embodiment of the present invention.

The horizontal member 4B shown in FIG. 35 comprises a single horizontal pipe and metallic pieces 36, 36 provided integrally at both ends of the pipe. The metallic pieces 36, 36, which are each formed by a bifurcated shoe, are inserted detachably into flanges 7 of front and rear support posts 1, 1 opposed to each other.

Figure 36:
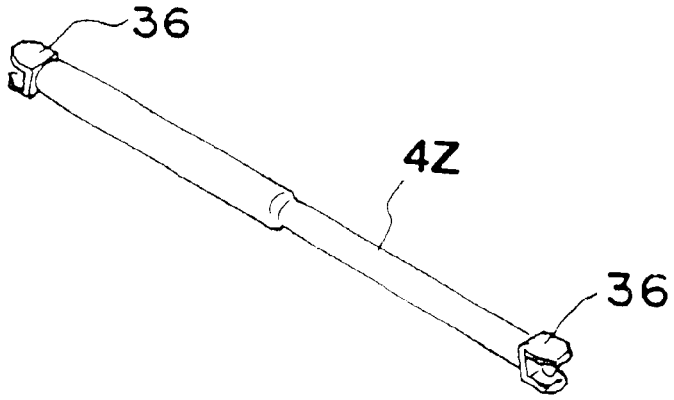
FIG. 36 is a perspective view of a horizontal member according to a still further embodiment of the present invention.

The horizontal member 42 shown in FIG. 36 comprises an outer tube and an inner tube inserted for expansion and retraction into the outer tube, with metallic pieces 36 being provided respectively at end portions of both tubes, whereby the length between front and rear support posts 1, 1 can be adjusted as desired.

Figure 37:
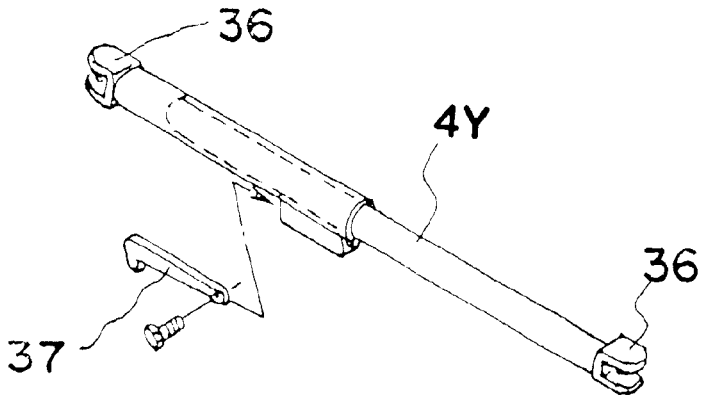
FIG. 37 is a perspective view of a horizontal member according to a still further embodiment of the present invention.
Figure 38:
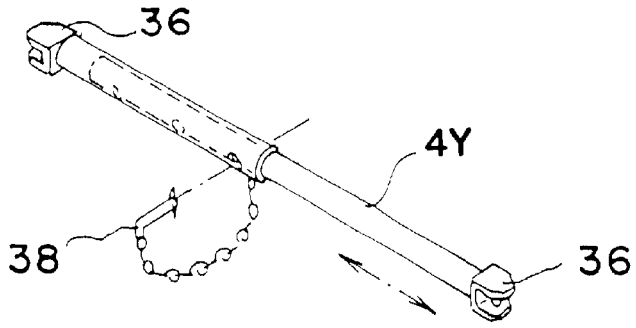
FIG. 38 is a perspective view of a horizontal member according to a still further embodiment of the present invention.

The horizontal members 4*Y* shown in FIGS. 37 and 38, like the horizontal member shown in FIG. 36, are each also constituted by tubes capable of expansion and retraction and are each positioned using a wedge 37 or a pin 38.

Figure 39:
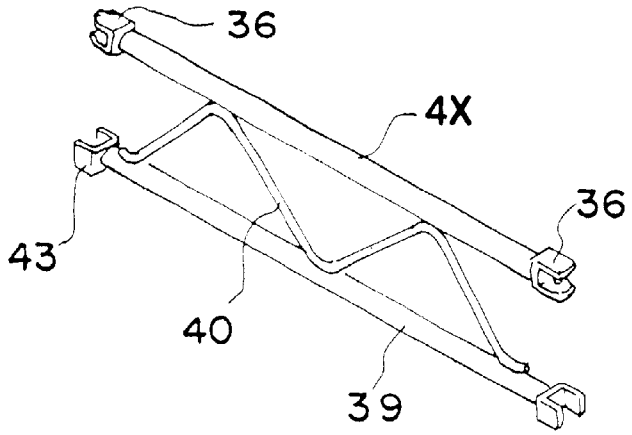
FIG. 39 is a perspective view of a horizontal member according to a still further embodiment of the present invention.

The horizontal member 4*X* shown in FIG. 39 is constituted by two upper and lower pipes. The lower pipe, indicated at 39, is connected below and in parallel with the upper pipe through a brace 40. The pipe 39 is provided with U-shaped metallic pieces 43.

Figure 40:
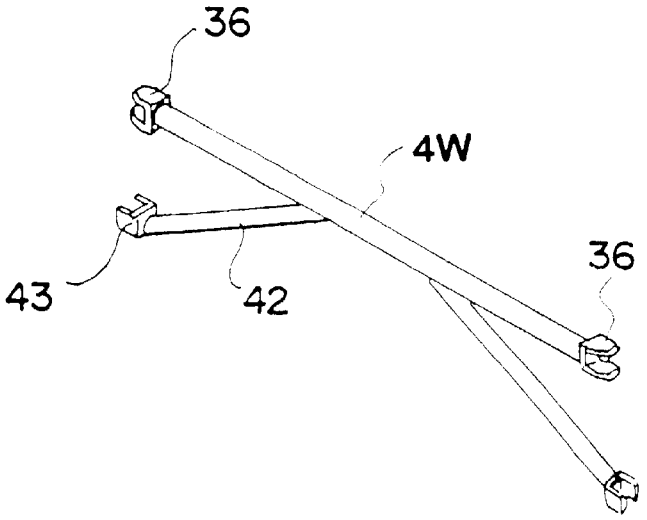
FIG. 40 is a perspective view of a horizontal member according to a still further embodiment of the present invention.

The horizontal member 4*W* shown in FIG. 40 comprises a pipe and diagonal members 42, 42 secured to the underside of the pipe, with U-shaped metallic pieces 43 for connection to support posts 1 are provided at end portions of the diagonal members 42, 42.

Figure 41:
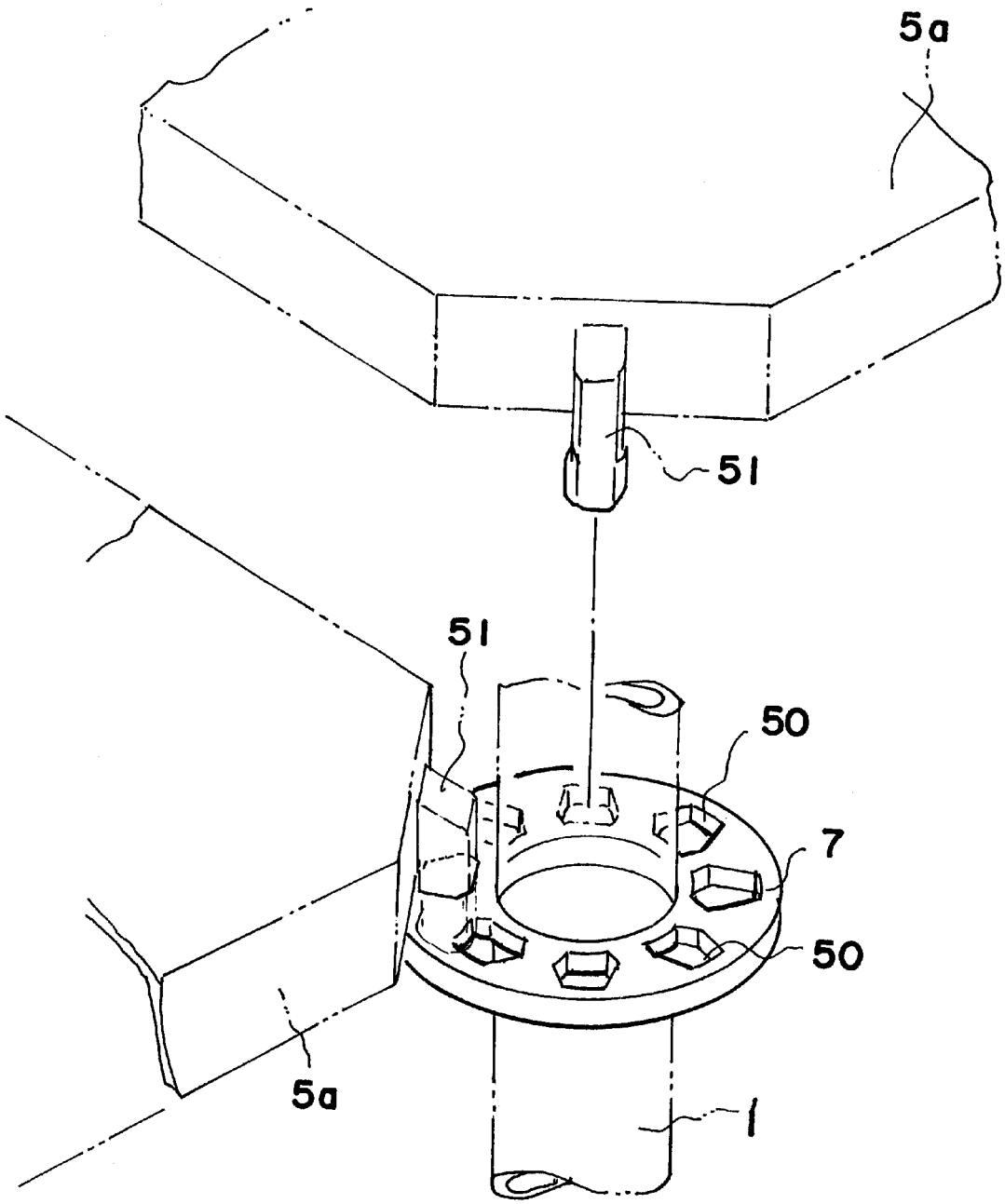
FIG. 41 is a partially cut-away perspective view of a scaffolding board and a support post according to a still further embodiment of the present invention.

FIG. 41 illustrates a different method for mounting scaffolding boards according to a still further embodiment of the present invention.

To be more specific, a plurality of frames 3 each comprising two parallel, upright support posts 1, 1 and a balustrade 2 mounted laterally between the support posts are arranged laterally in two front and rear rows, and support posts 1, 1 adjacent to each other laterally are interconnected through the said balustrade 2 or another balustrade 2*a*, further, one or plural scaffolding boards 5*a* are arranged laterally in series between the front and rear frames 3, 3. In this prefabricated scaffolding, the four corners of each scaffolding board 5*a* are detachably connected respectively to the corresponding support posts.

In this case, a flange 7 having a plurality of holes 50 formed in the circumferential direction is provided at an approximately intermediate position of each support post 1, while retaining pins 51 are provided downward at the four corners of the scaffolding board 5*a*, and each retaining pin 51 is inserted into any of the holes 50 of the flange 7 to fix the scaffolding board 5*a*.

By so doing, the front and rear upright support posts 1, 1 are connected together even without the use of horizontal member 4, provided it is preferable that the horizontal member 4 be mounted between the front and rear support posts 1, 1 because it serves as both a reinforcing member and a balustrade.

The mounting method shown in FIG. 41 is for the scaffolding boards 5*a* in place of the scaffolding boards 5 shown in FIG. 1, but is applicable also to the prefabricated scaffolding shown in FIG. 4.

Figure 42:
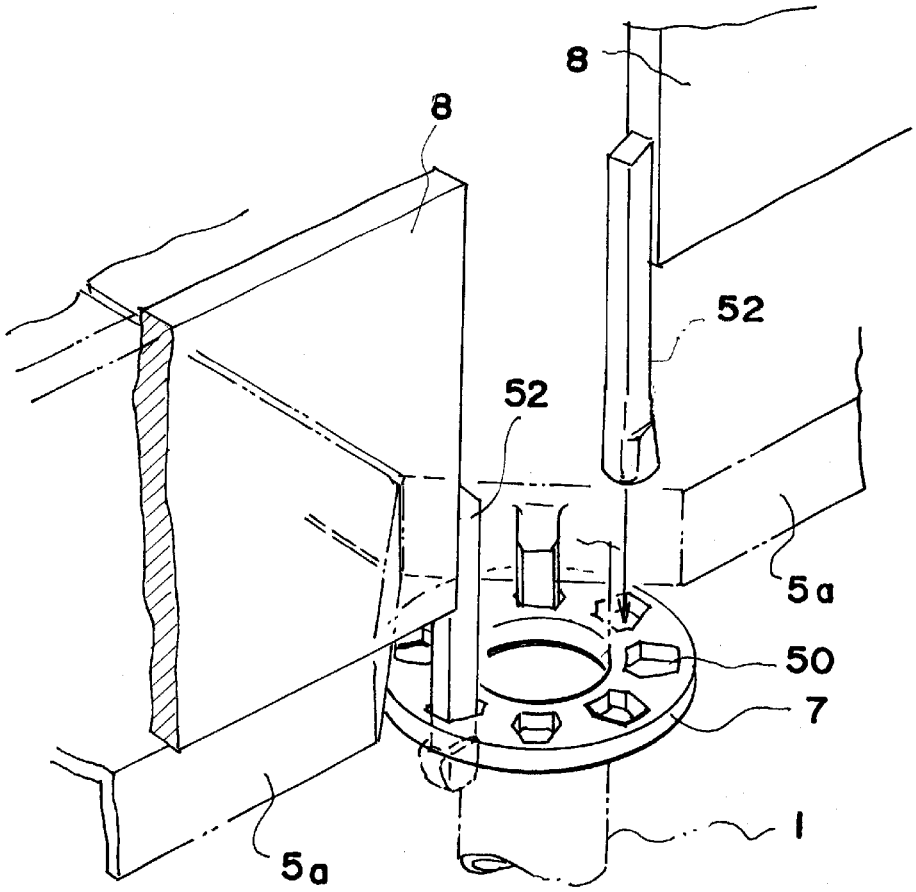
FIG. 42 is a partially cut-away perspective view of a baseboard and a support post according to a still further embodiment of the present invention.

FIG. 42 illustrates a still further embodiment of the present invention, in which baseboards 8 are mounted with use of the flange 7 shown in FIG. 41. More specifically, retaining pins 52 are provided downward at both ends of the baseboards and are inserted into holes 50 of the flange 7 to raise the baseboards along and in front and rear positions of scaffolding boards 5*a*.

Figure 43:
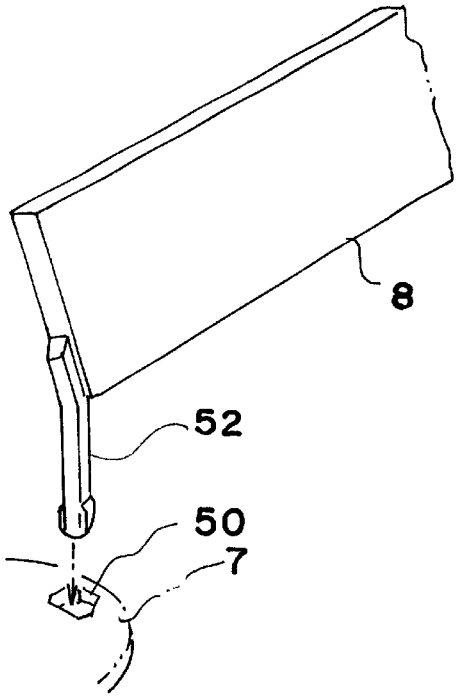
FIG. 43 is a perspective view of the baseboard according to a still further embodiment of the present invention.

The retaining pins 52 of each baseboard 8 may each be inclined a little at the lower portion thereof as in FIG. 43 which illustrates a still further embodiment of the present invention.

Figure 44:
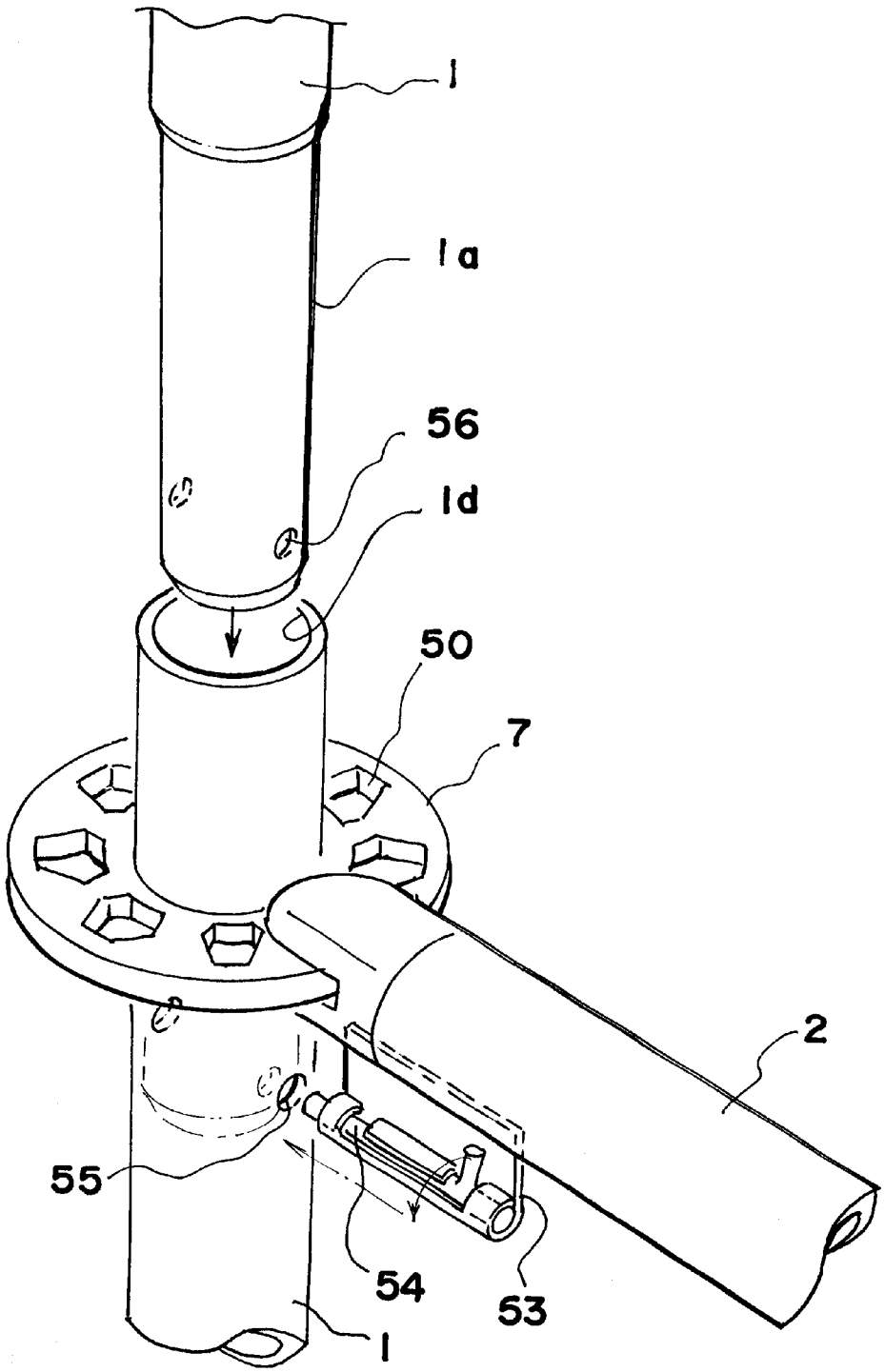
FIG. 44 is a partially cut-away perspective view showing an interconnected state of support posts according to a still further embodiment of the present invention.

FIGS. 44 to 47 illustrate still further embodiments of the present invention, in which support posts 1 are vertically connected together. In FIG. 44, a lower-end spigot portion 1*a* of an upper support post 1 is inserted into an upper-end socket portion 1*d* of a lower support post 1.

A flange 7 having holes 50 is mounted on the lower support post 1 and a balustrade 2 is horizontally fitted on the flange 7. A pin 54 is mounted horizontally movably to the lower front end portion of the balustrade 2 through a bracket 53, while retaining holes 55 and 56 are formed in the lower support post 1 and the spigot portion 1*a* of the upper support post. When the spigot portion 1*a* is inserted into the socket portion 1*d* and then the pin 54 is inserted sideways into the retaining holes 55 and 56, the upper support post 1 can no longer be pulled out.

Figure 45:
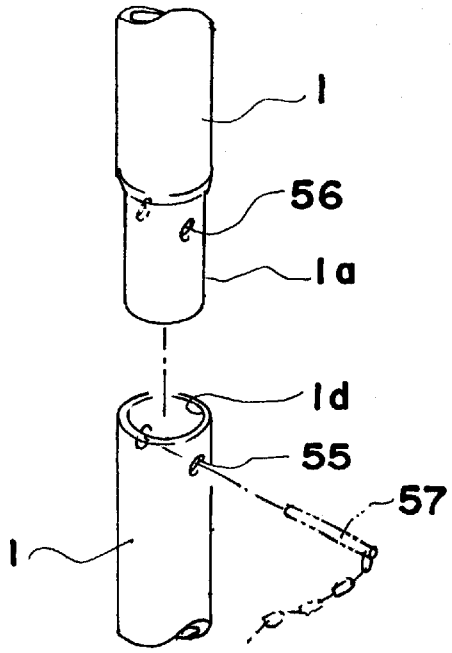
FIG. 45 is a partially cut-away perspective view showing an interconnected state of support posts according to a still further embodiment of the present invention.

In FIG. 45, the socket portion id of the lower support post 1 and the spigot portion 1*a* of the upper support post inserted into the socket portion 1*d* are secured to each other with an ordinary type of pin 57.

Figure 46:
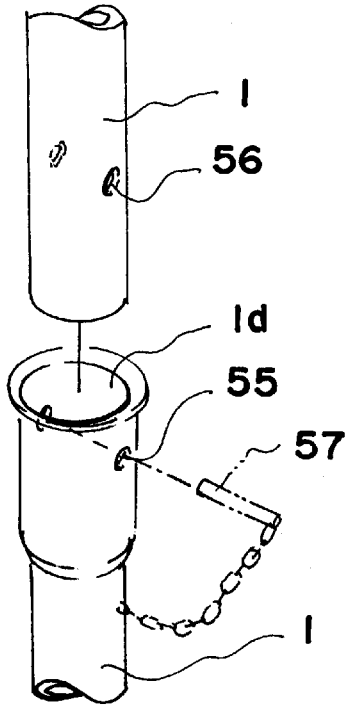
FIG. 46 is a partially cut-away perspective view showing an interconnected state of support posts according to a still further embodiment of the present invention.

In FIG. 46, the socket portion 1*d* of the lower support post 1 is expanded in diameter to permit the upper support post 1 to be inserted directly into the socket portion without using a spigot portion, and the socket portion 1*d* and the upper support post 1 are secured to each other with pin 57.

Figure 47:
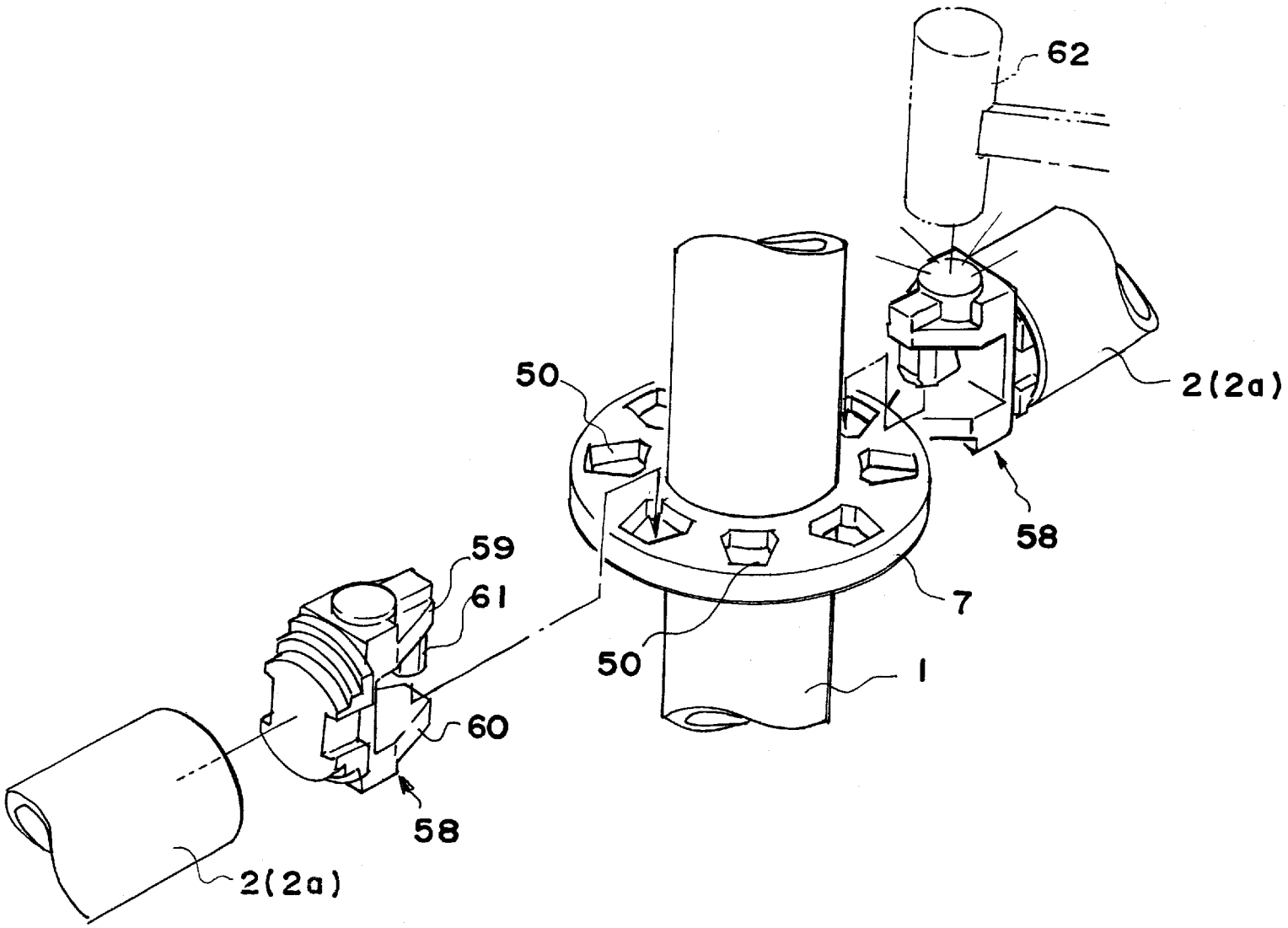
FIG. 47 is an exploded perspective view showing an interconnected state of a support post and balustrades.

FIG. 47 illustrates a concrete method for mounting a balustrade 2 or 2*a* to a support post 1 according to a still further embodiment of the present invention.

A flange 7 having holes 50 is connected to a support post 1, while to the front end of a balustrade 2 or 2*a* is connected a shoe 58 having clamping pieces 59, 60 and a pin 61. The clamping pieces 59 and 60 are fitted on the flange 7 and then the pin 61 is fitted in a hole 50 forcibly by striking it with a hammer 62 or the like to connect the balustrade 2 or 2*a* to the support post 1 through the flange 7 and shoe 58.

The following description is now provided about frames according to still further embodiments of the present invention, in which common components are identified by the same reference numerals.

Figure 99:
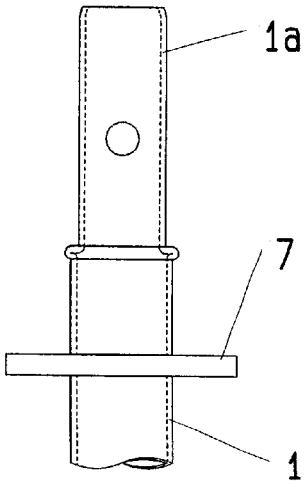
FIG. 99 is an enlarged front view of an upper portion of a support post.

The frames illustrated in FIGS. 48 to 52 belong to the first group. They are common to one another in point of comprising one support post 1, a flange 7 or flanges 7, 7 as a first connector support member(s) provided at an intermediate position(s) of the support post 1, a horizontal member 2*a* or horizontal members 2*a*, 2*a* provided sideways of the support post 1, a metallic piece 13 or metallic pieces 13, 13 provided at an outer end(s) of the horizontal member(s) 2*a*, the metallic piece 13 comprising a shoe and a wedge. The support post 1 is constituted by a pipe. As shown in FIG. 99, a spigot portion 1*a* of a small diameter is formed at the upper end of the support post 1. The spigot portion 1*a* can be inserted detachably into the lower portion of the support post 1 located above the support post in question and then fixed with a pin. In the frame shown in FIG. 48, a base end of a horizontal member 2*a* is connected to an intermediate flange 7. In the frame shown in FIG. 49, two horizontal members 2*a*, 2*a* are connected respectively to two upper and lower flanges 7, 7.

Figure 90:
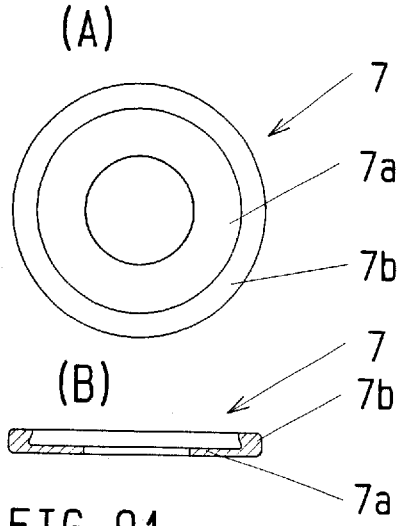
FIG. 90(A) is a plan view of a flange and FIG. 90(B) is a sectional view thereof.
Figure 91:
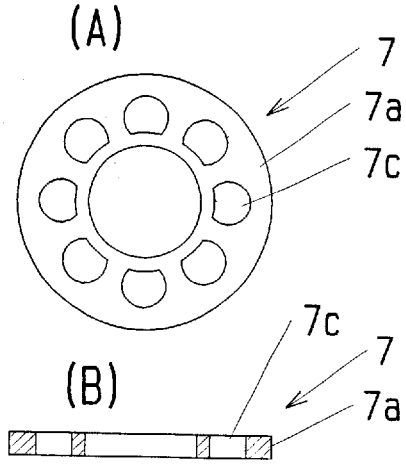
FIG. 91(A) is a plan view of another flange and FIG. 91(B) is sectional view thereof.

As shown in FIGS. 90(A) and (B), each flange 7 comprises a central disc 7*a* and an annular hook 7*b* formed on the outer periphery of the disc 7*a*. Alternatively, as shown in FIGS. 91(A) and 91(B), each flange 7 comprises a disc 7*a* and eight retaining holes 7*c* formed in the circumferential direction of the disc 7*a*.

Figure 92:
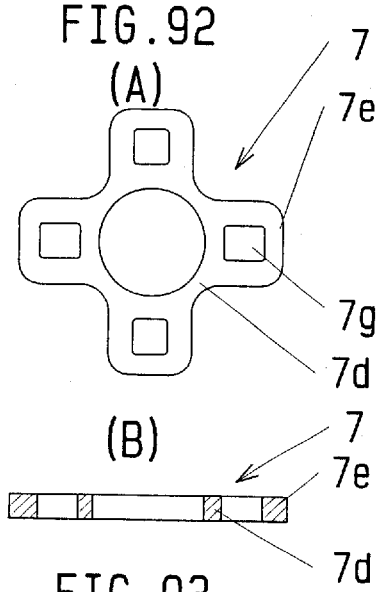
FIGS. 92(A) and (B) are a plan view and a sectional view, respectively, of a still another flange.
Figure 93:
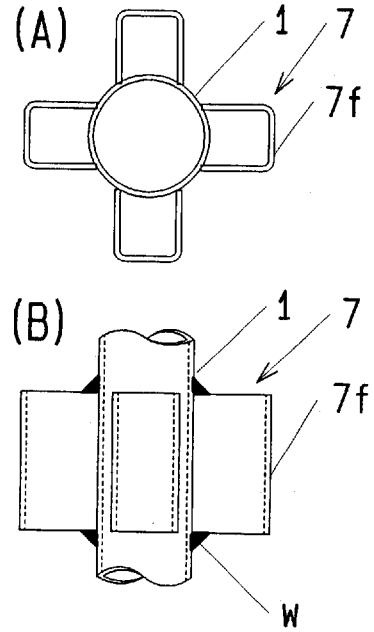
FIGS. 93(A) and (B) are a plan view and a sectional view, respectively, of a still another flange.

There also may be used such flanges as shown in FIGS. 92(A),(B) and 93(A),(B). The flange 7 shown in FIGS. 92(A) and (B) comprises a body 7*a*, lug pieces 7*e* provided on the body 7*a* at 900 intervals in four directions, and retaining holes 7*g* formed respectively in the lug pieces 7*e*. The flange 7 shown in FIGS. 93(A) and (B) comprises sockets 7*f* of a U-shaped section formed at 900 intervals in four directions on the outer periphery of a support post 1, the sockets 7*f* being welded at W to the outer periphery of the support post 1.

Figure 50:
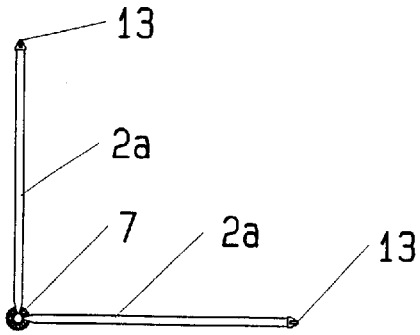
FIG. 50 is a front view of a frame according to a still further embodiment of the present invention.
Figure 51:
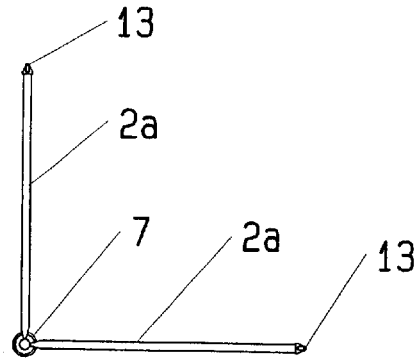
FIG. 51 is a plan view of a frame according to a still further embodiment of the present invention.
Figure 94:
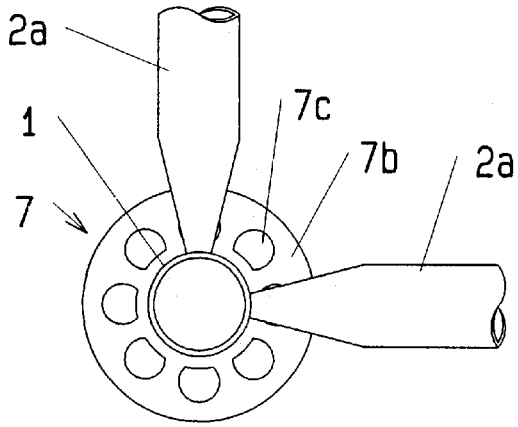
FIG. 94 is an enlarged plan view of a connection between a flange and horizontal members.
Figure 95:
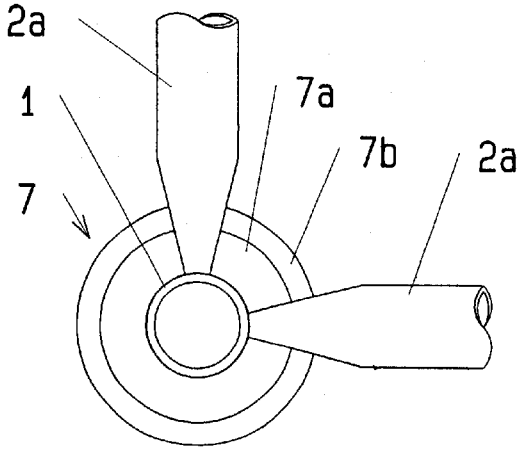
FIG. 95 is an enlarged plan view of a connection between another flange and horizontal members.

In each of the frames shown in FIGS. 50 and 51, two horizontal members 2*a*, 2*a* are connected perpendicularly to an upper or intermediate flange 7. For example, the horizontal members 2*a*, 2*a* are mounted to the flange 7 in such a state as shown in an enlarged plan view of FIG. 94 or 95.

Figure 52:
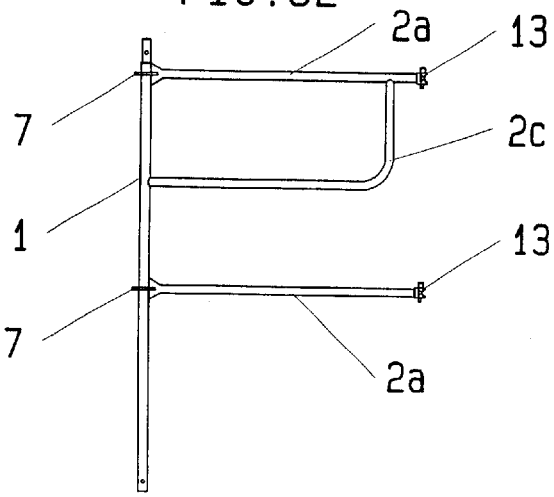
FIG. 52 is a front view of a frame according to a still further embodiment of the present invention.

In the frame shown in FIG. 52, a horizontal member 2*a* is connected to an intermediate flange 7 and a lateral member comprising a horizontal member 2*a* and an L-shaped reinforcing frame 2*c* is secured to an upper flange 7.

Figure 53:
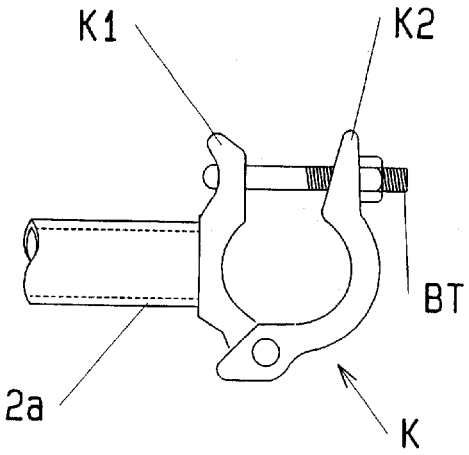
FIG. 53 is a plan view of a connector according to a still further embodiment of the present invention.

As a connector provided at an outer end of the lateral member is used a metallic piece 13 comprising a bifurcated shoe and a wedge, but this does not always constitute a limitation. For example, there may be used such a clamp K as shown in FIG. 53. The clamp K comprises two clamping pieces K1 and K2 which are hinged together, and a bolt BT for tightening the clamping pieces K1 and K2. The clamp K is secured to each of first and second connector support members provided on the support post 1 side. It is also possible to clamp the support post 1 directly. The clamp K can be mounted to outer ends of all of horizontal members according to other embodiments of the present invention.

FIGS. 54 to 56 illustrate frames according to still further embodiments of the present invention, which frames belong to the second group. As shown in FIG. 54, each of these frames basically comprises one support post 1, flanges 7, 7 mounted at intermediate and upper positions of the support post 1, a frame member 2A whose upper base end is connected to the upper flange 7, and metallic pieces 13 mounted at outer ends of the frame member 2A, thereby constituting a frame 3A. The frame 2A comprises a horizontal member P, a vertical member Q and a diagonal member R. A trapezoidal frame in front view is constituted by both post 1 and frame member 2A.

In the frame shown in FIG. 55(A), a horizontal reinforcing member 2A1 is mounted between a support post 1 and an intermediate position of the frame member 3A.

In the frame shown in FIG. 55(B), in addition to the reinforcing member 2A1, another reinforcing member 2A2 is mounted between the intermediate flange 7 and the frame member 3A.

In the frame shown in FIG. 56, both frame member 2*a* and reinforcing frame 2*a*1 are connected to flanges 7 and metallic pieces 13 are mounted at the frame outer ends corresponding to the flanges 7. The frame thus constituted is rectangular as a whole.

FIGS. 57 to 67 illustrate frames according to still further embodiments of the present invention, which frames belong to the third group. As shown in FIG. 57, the frames each basically comprise a support post 1, flanges 7 mounted at intermediate and upper positions of the support post 1, frame members 2*b* mounted in V shape sideways of the support post 1, and a metallic piece 13 mounted at outer ends of the frame members 2*b*. The frame thus constituted, which is indicated at 3B, is triangular in front view. In the frame of FIG. 57, base ends of the frame members 2*b* are connected respectively to upper and lower positions of the support post 1 by welding for example.

Figure 58:
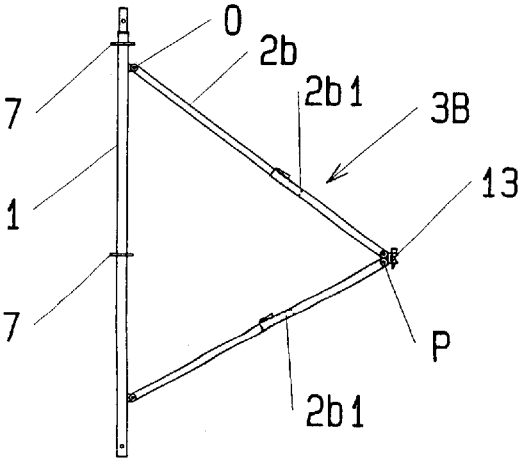
FIG. 58 is a front view of a frame according to a still further embodiment of the present invention.

In the frame shown in FIG. 58, the frame members 2*b* are adjusted in length through length adjusting mechanisms 2*b*1, base ends of the frame members 2*b* are hinged to the support post 1 through brackets O, and outer ends thereof are also hinged together through a hinge portion P.

Figure 59:
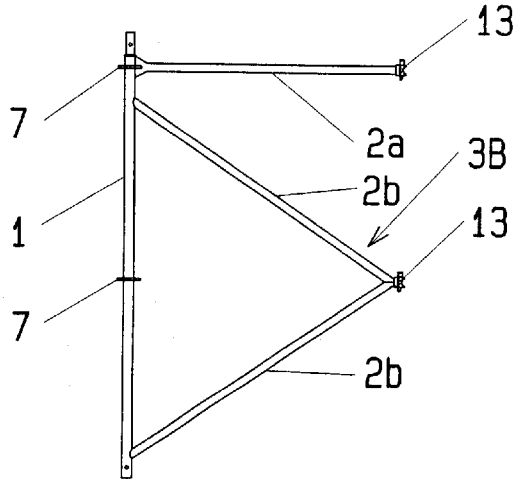
FIG. 59 is a front view of a frame according to a still further embodiment of the present invention.

According to the frame shown in FIG. 59, in addition to the basic structure shown in FIG. 57, a horizontal member 2*a* is connected to the upper flange 7.

Figure 60:
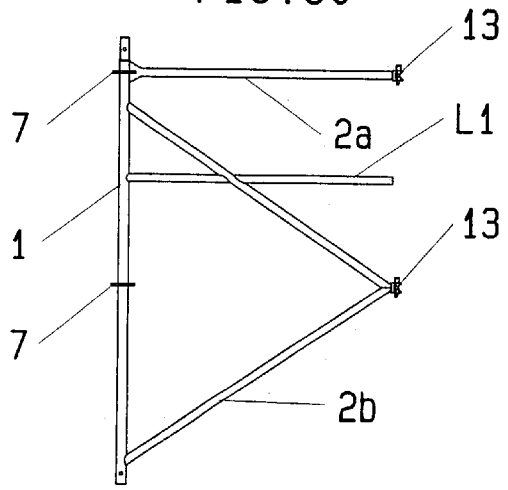
FIG. 60 is a front view of a frame according to a still further embodiment of the present invention.

According to the frame shown in FIG. 60, in addition to the basic structure shown in FIG. 57, a horizontal member 2*a* is connected to the upper flange 7 and a reinforcing horizontal member L1 is mounted in parallel with the horizontal member 2*a* so as to intersect a frame member 2*b*.

Figure 61:
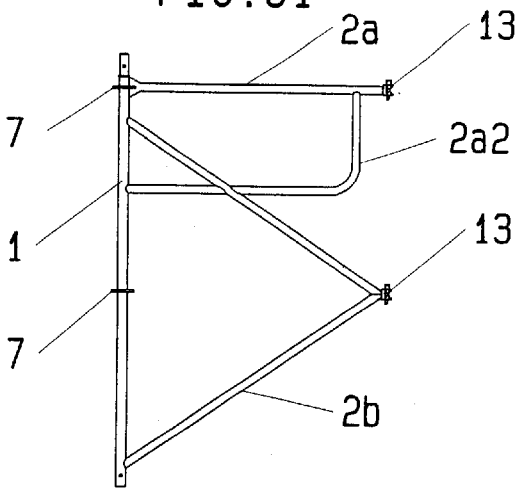
FIG. 61 is a front view of a frame according to a still further embodiment of the present invention.

The frame shown in FIG. 61 is a modification of the frame shown in FIG. 60, in which a base end of a reinforcing horizontal member L2 and a front end thereof are connected to the support post 1 and the horizontal member 2*a*, respectively, while allowing the reinforcing horizontal member L2 to intersect a frame member 2*b* at an intermediate position thereof.

Figure 62:
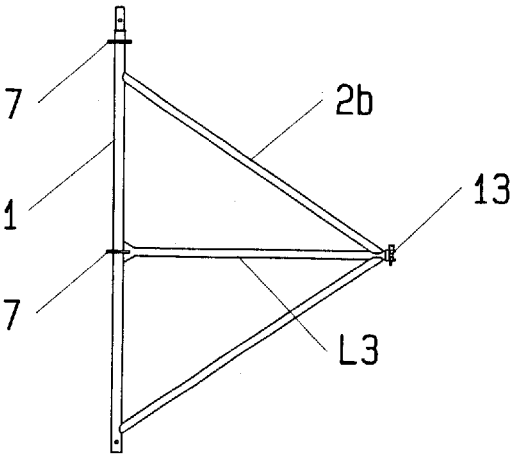
FIG. 62 is a front view of a frame according to a still further embodiment of the present invention.

According to the frame shown in FIG. 62, a reinforcing frame member L3 constituted by a horizontal member is mounted centrally between frame members 2*b* and is connected to both an intermediate flange 7 and the center of outer ends of the frame members 2*b*.

Figure 63:
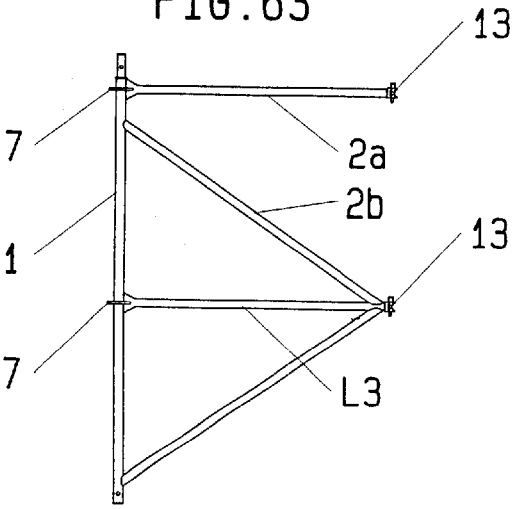
FIG. 63 is a front view of a frame according to a still further embodiment of the present invention.

According to the frame shown in FIG. 63, in addition to the components of the frame shown in FIG. 62, a horizontal member 2*a* is connected to the upper flange 7 in parallel with the horizontal frame member L3. According to the frame shown in FIG. 64, the horizontal frame member L3 and a U-shaped frame member are connected to frame members 2*b*, and metallic pieces 13 corresponding to flanges 7 are mounted at outer end positions of the frame member L4.

Figure 65:
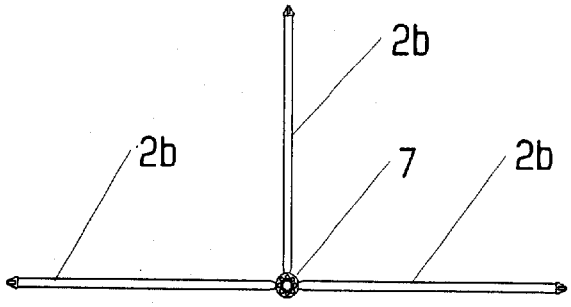
FIG. 65 is a plan view of a frame according to a still further embodiment of the present invention.
Figure 67:
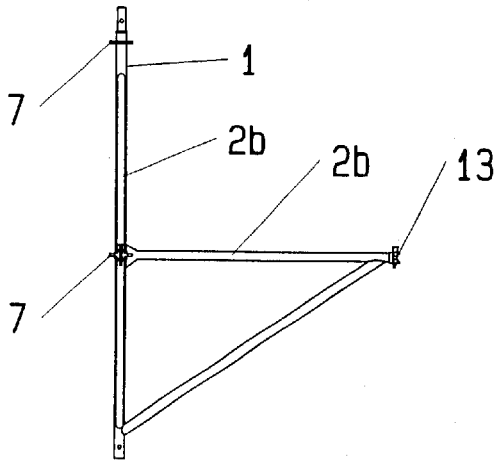
FIG. 67 is a right side view of FIG. 65.
Figure 66:
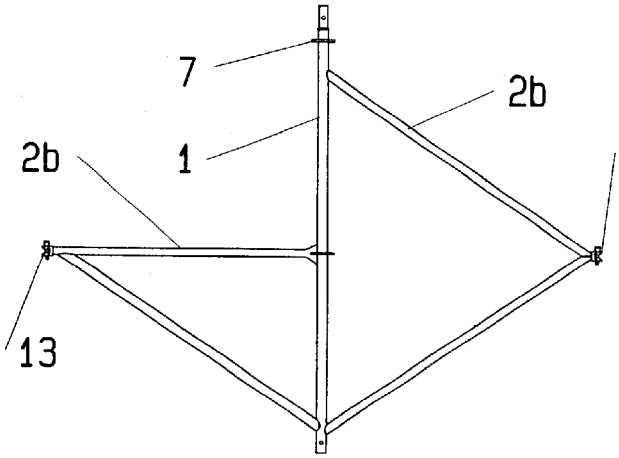
FIG. 66 is a front view of FIG. 65.

FIGS. 65, 66 and 67 are a plan view, a front view and a right side view, respectively, showing an example in which three V-shaped frame members 2*b* are provided at 90° shifted positions with respect to a support post 1.

FIGS. 68 to 83 illustrate frames according to still further embodiments of the present invention, which frames belong to the fourth group. These frames are common to one another in that they each comprise a support post 1, frame members 2C mounted in V shape sideways of the support post 1, and a metallic piece 13 as a connector mounted at outer ends of the frame members. The support post 1 and the frame members 2C constitute a frame 3C which is in the shape of a right-angled triangle in front view.

In the frame shown in FIG. 68, base ends of frame members 2C are connected respectively to an upper flange 7 and a lower part of the support post 1.

Figure 69:
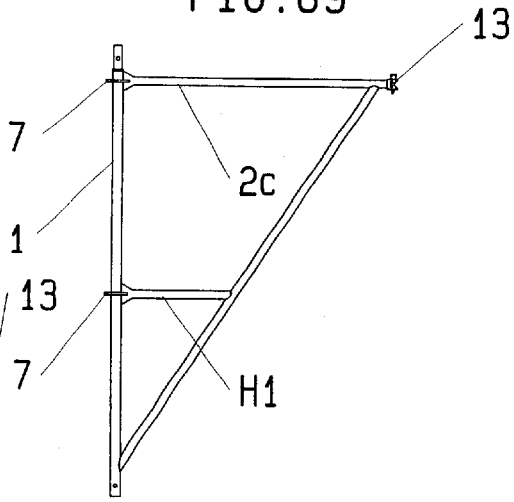
FIG. 69 is a front view of a frame according to a still further embodiment of the present invention.

In the frame shown in FIG. 69, a reinforcing frame H1 constituted by a horizontal member is mounted between a frame member 2C and an intermediate flange 7.

Figure 70:
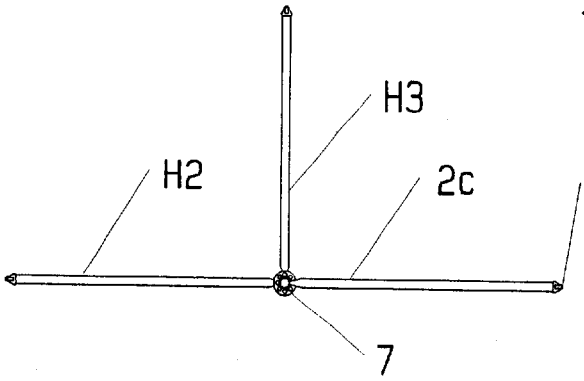
FIG. 70 is a plan view of a frame according to a still further embodiment of the present invention.
Figure 71:
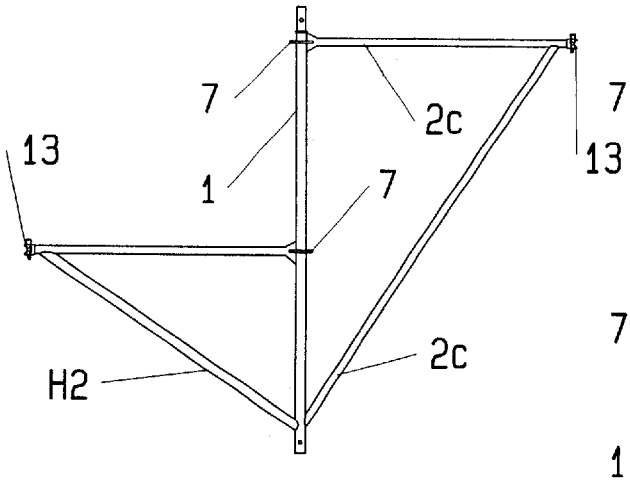
FIG. 71 is a front view of FIG. 70.
Figure 72:
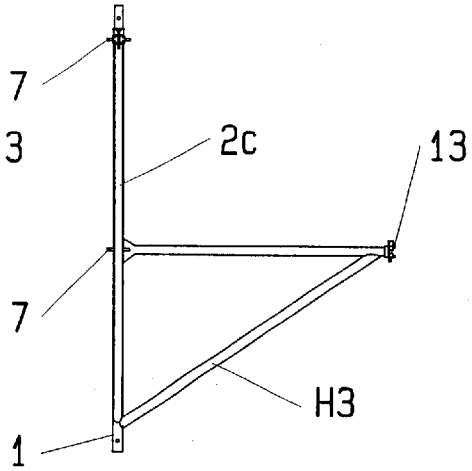
FIG. 72 is a right side view of FIG. 70.

FIGS. 70, 71 and 72 are a plan view, a front view and a right side view, respectively, of frames, in which two triangular frame members H2 and H3 each comprising a horizontal member and a diagonal member are mounted at 90° shifted positions with respect to a frame member 2C, and upper base ends of the triangular frames H2 and H3 are connected to an intermediate flange 7.

Figure 73:
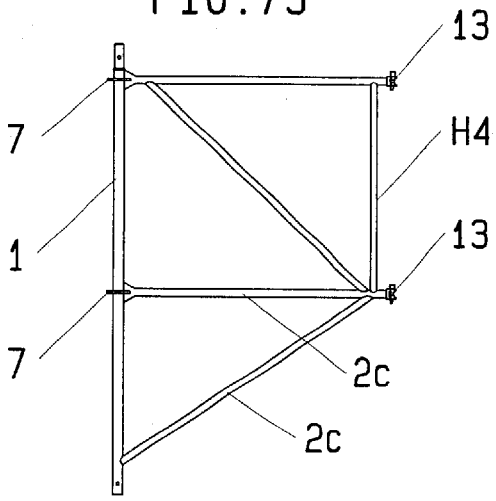
FIG. 73 is a front view of a frame according to a still further embodiment of the present invention.

In the frame shown in FIG. 73, a V-shaped frame member 2C is secured to an intermediate flange 7 and a triangular frame member H4 is mounted between the frame member 2C and an upper flange 7.

Figure 74:
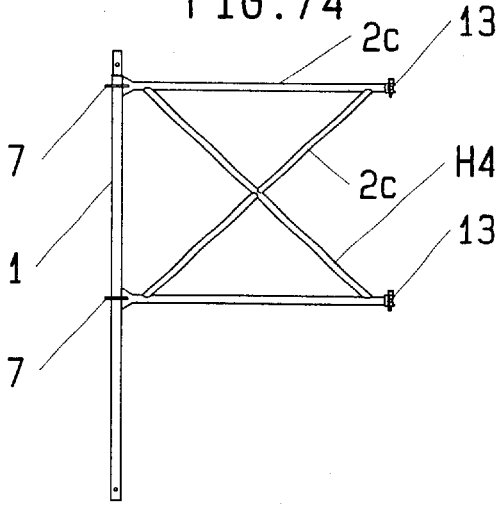
FIG. 74 is a front view of a frame according to a still further embodiment of the present invention.

In the frame shown in FIG. 74, a triangular frame member H4 having the same shape as the shape of a V-shaped frame member 2C is mounted so as to intersect the frame member 2C.

Figure 75:
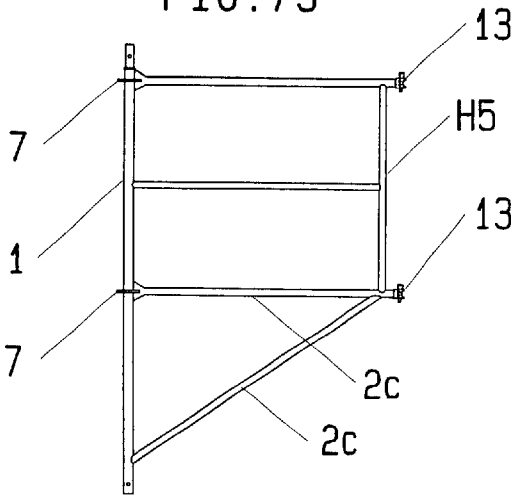
FIG. 75 is a front view of a frame according to a still further embodiment of the present invention.

According to the frame shown in FIG. 75, which is substantially the same as the frames shown in FIGS. 73 and 74, a rectangular frame member H comprising two horizontal members and one vertical support post is mounted above a V-shaped frame member 2C.

Figure 76:
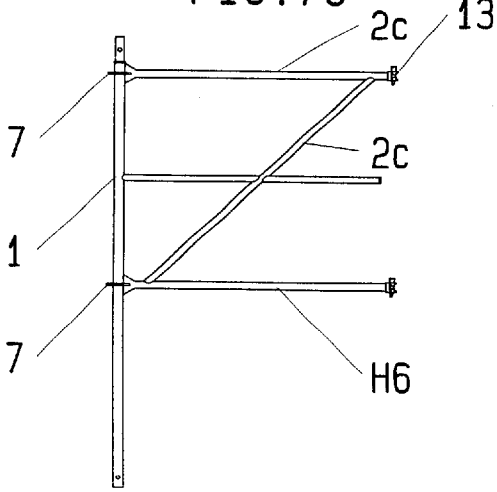
FIG. 76 is a front view of a frame according to a still further embodiment of the present invention.

In FIG. 76, a frame member H6 comprising two parallel horizontal members is mounted so as to intersect a V-shaped frame member 2C.

Figure 77:
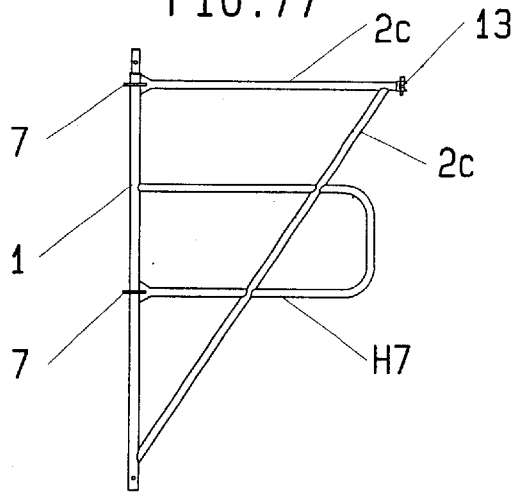
FIG. 77 is a front view of a frame according to a still further embodiment of the present invention.

In FIG. 77, a U-shaped frame member H7 is mounted so as to intersect a V-shaped frame member 2C.

Figure 78:
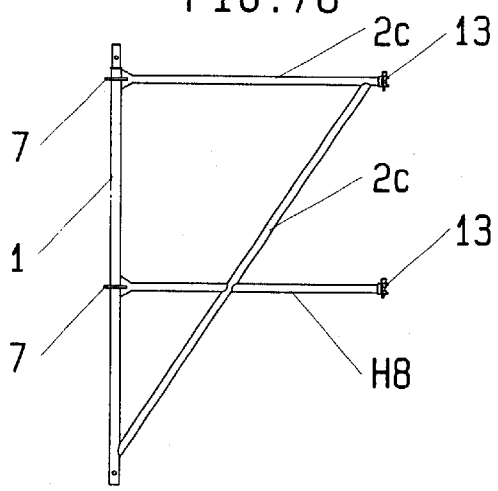
FIG. 78 is a front view of a frame according to a still further embodiment of the present invention.

In FIG. 78, a frame member H8 constituted by one horizontal member is mounted so as to intersect a V-shaped frame member 2C.

Figure 79:
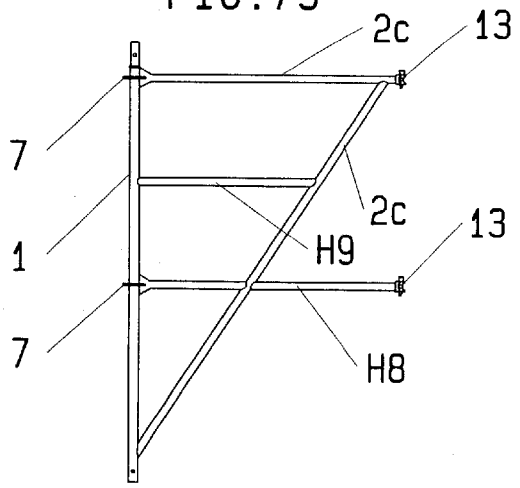
FIG. 79 is a front view of a frame according to a still further embodiment of the present invention.

In FIG. 79, in addition to the frame member H8 shown in FIG. 78, a reinforcing frame member H9 is mounted in parallel with the frame member H8.

Figure 80:
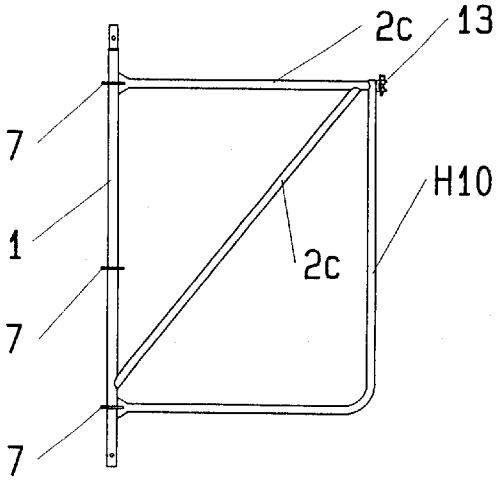
FIG. 80 is a front view of a frame according to a still further embodiment of the present invention.

In FIG. 80, an L-shaped reinforcing frame H10 is connected below a V-shaped frame member 2C.

Figure 81:
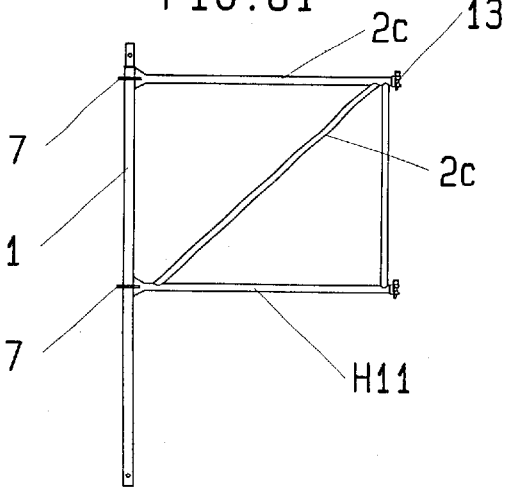
FIG. 81 is a front view of a frame according to a still further embodiment of the present invention.

In FIG. 81, a right-angled frame H11 is connected below a V-shaped frame 2C.

Figure 82:
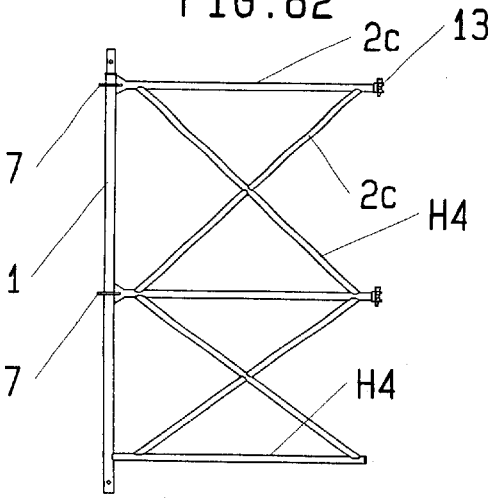
FIG. 82 is a front view of a frame according to a still further embodiment of the present invention.

The frame shown in FIG. 82 is a modification of the frame shown in FIG. 74, in which two upper and lower frame members H4 are mounted with respect to the V-shaped frame member 2C.

Figure 83:
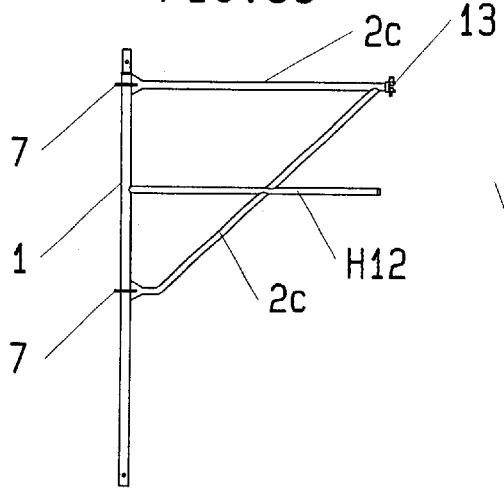
FIG. 83 is a front view of a frame according to a still further embodiment of the present invention.

In FIG. 83, base ends of a V-shaped frame member 2C are connected respectively to an upper flange 7 and an intermediate flange 7, and a horizontal member H12 is mounted at an intermediate position of the frame 2C.

Figure 84:
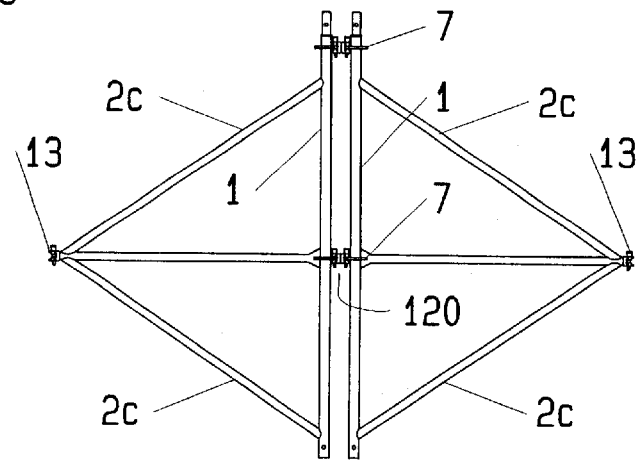
FIG. 84 is a front view of a frame according to a still further embodiment of the present invention.
Figure 85:
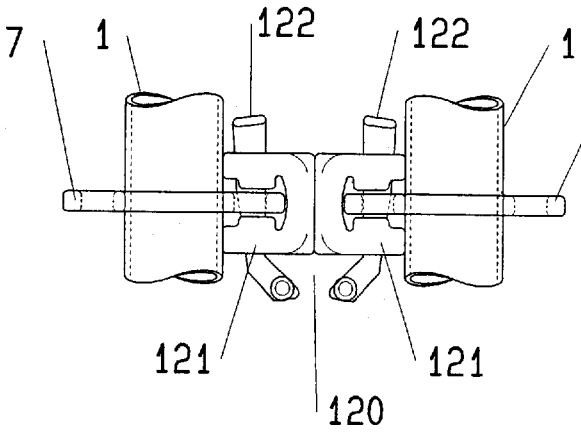
FIG. 85 is a partially enlarged front view of FIG. 84.

In FIGS. 84 and 85, two support posts 1 are raised in parallel with each other and connected together through connectors 120 disposed respectively between upper flanges 7, 7 and between intermediate flanges 7, 7, and V-shaped frame members 2C, 2C are connected respectively to the support posts 1, 1 so as to face in opposite directions.

Figure 97:
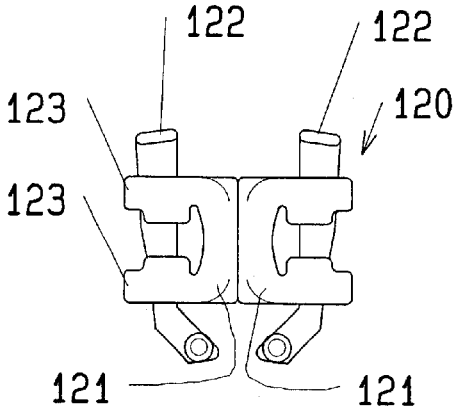
FIG. 97 is an enlarged front view of a connecting member.

As shown in FIGS. 85 and 97, the connector 120 each comprise two bifurcated shoes 121 connected together at the respective back sides and wedges 122 fitted in the shoes 121 removably. Upper and lower clamping pieces 123 of each shoe 121 are inserted into a perforated flange 7 and the associated wedge 122 is driven into holes formed in both shoe 122 and flange 7.

The above connector comprising the shoes 121, clamping pieces 123 and wedges 122 are substantially the same in structure as the metallic piece 13 used as a connector in each of the frames described previously.

FIGS. 86 to 89 illustrate frames according to still further embodiments of the present invention, which frames belong to the fifth group.

Figure 86:
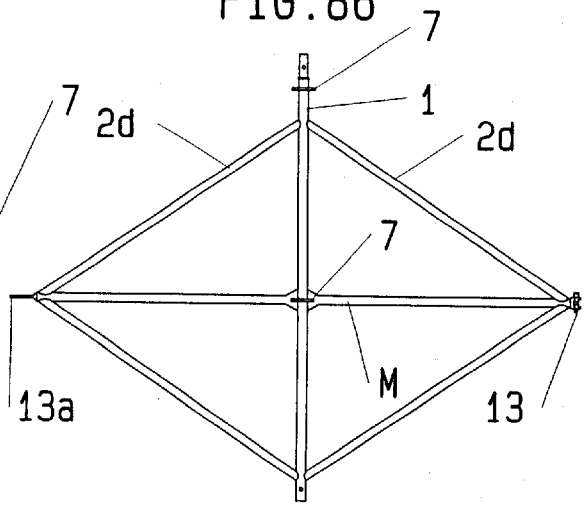
FIG. 86 is a front view of a frame according to a still further embodiment of the present invention.

The frame shown in FIG. 86 comprises a support post 1, a flange 7 mounted at an intermediate position of the support post 1, V-shaped frame members 2D, 2D as lateral members provided on both sides of the support post 1, a metallic piece 13 as a connector corresponding to the intermediate flange 7 and mounted at an outer end of one V-shaped frame member 2D, and a metallic piece 13A constituted by a horizontal plate as a third connector support member corresponding to the metallic piece 13, the metallic piece 13A being mounted at an outer end of the other V-shaped frame member 2D.

Centrally of each V-shaped frame member 2D is mounted a reinforcing horizontal member M connected to the intermediate flange 7.

Figure 87:
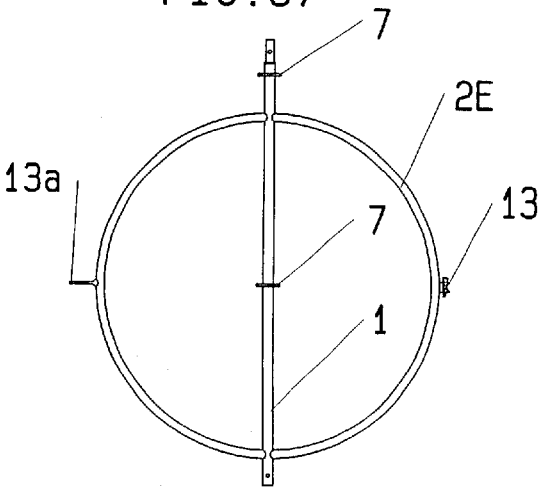
FIG. 87 is a front view of a frame according to a still further embodiment of the present invention.

FIG. 87 illustrates a frame according to a still further embodiment of the present invention, which uses semicircular frame members 2E, 2E instead of the V-shaped frame members 2D shown in FIG. 86.

Figure 88:
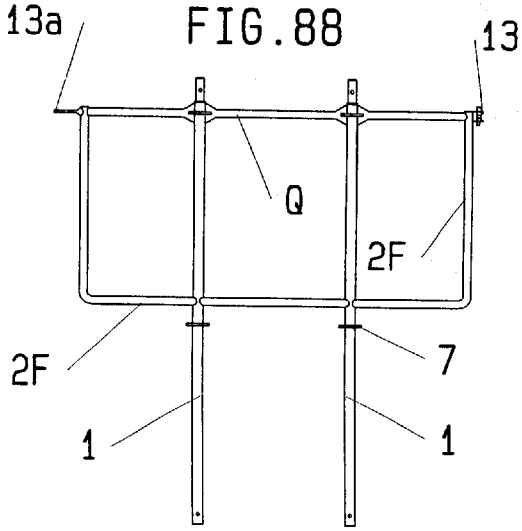
FIG. 88 is a front view of a frame according to a still further embodiment of the present invention.

The frame shown in FIG. 88 comprises two support shafts 1, 1 connected together through two intermediate horizontal members Q, a U-shaped frame member 2F as a lateral member secured to one support post 1, another U-shaped frame member 2F corresponding to the said frame member 2F and secured to the other support post 1, a metallic piece 13 mounted at an outer end of one frame member 2F, and a metallic piece 13A constituted by a horizontal plate and corresponding to the metallic piece 13, the metallic piece 13A being mounted at an outer end of the other frame member 2F.

Figure 89:
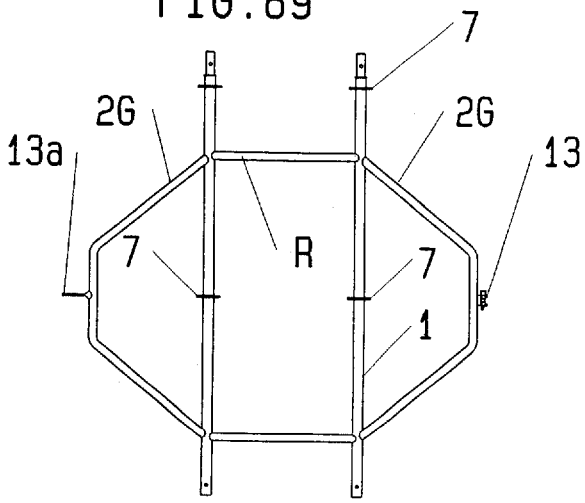
FIG. 89 is a front view of a frame according to a still further embodiment of the present invention.

The frame shown in FIG. 89 is a modification of the frame shown in FIG. 88. Generally V-shaped frame members 2G, 2G as lateral members are attached to support posts 1, 1, respectively. The support posts 1, 1 are connected together through two upper and lower horizontal members R.

Figure 96:
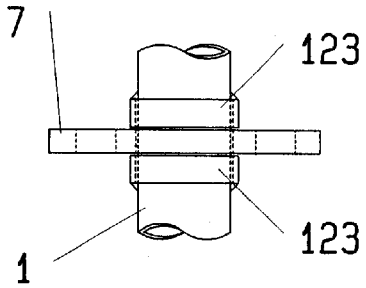
FIG. 96 is a front view of a still another flange.

FIG. 96 illustrate another type of flange 7.

More specifically, flanges 7 as first and second connector support members are each fitted on a support post 1 rotatably while being held between two upper and lower support rings which are fixed onto the outer periphery of the support post 1, so that a lateral member connected to the flange can also rotate in any direction with rotation of the flange 7.

Figure 98:
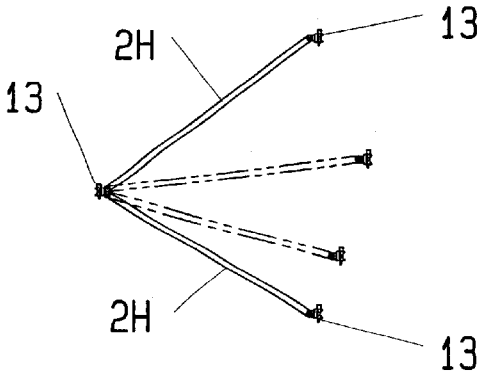
FIG. 98 is a front view of an auxiliary member.

FIG. 98 illustrates a horizontal member as a lateral member or a reinforcing member according to a still further embodiment of the present invention, which comprises two or more horizontal or diagonal members 2H, a metallic piece 13 hinged to base ends of the horizontal or diagonal members 2H, and metallic pieces 13 mounted at the opposite ends of the horizontal or diagonal members 2H. The horizontal or diagonal members 2H can be mounted in horizontal or diagonal directions as desired.

Figure 100:
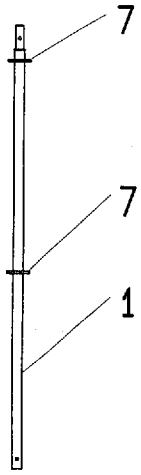
FIG. 100 is a front view of an auxiliary member constituted by a single support post.

FIG. 100 illustrates an auxiliary member, which comprises one support post 1 and flanges mounted at upper and intermediate positions of the support post 1. Of course, lateral members may be connected to the support post 1, as described previously.

Figure 101:
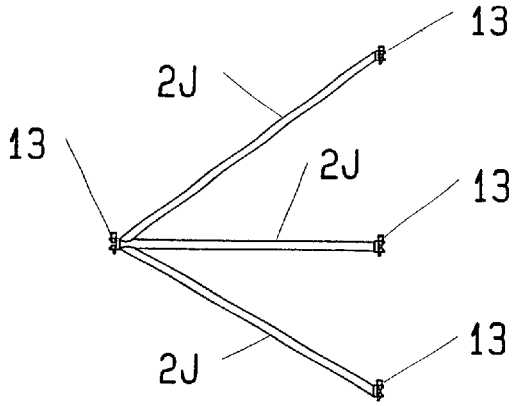
FIG. 101 is a front view of a still another auxiliary member.
Figure 102:
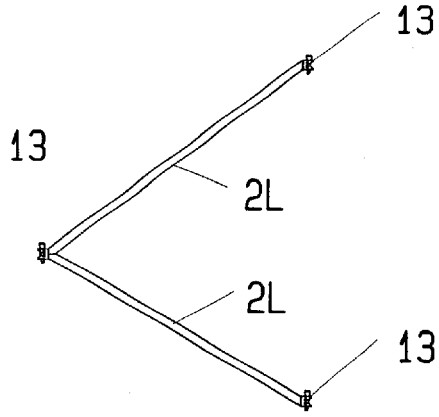
FIG. 102 is a front view of a still another auxiliary member.

FIGS. 101 and 102 show other examples of auxiliary members. In FIG. 101, one horizontal member 2J and two diagonal members 2J are fixed in the lateral direction, while in FIG. 102, two diagonal members 2L are mounted in V shape. Both auxiliary members are provided at end portions thereof with metallic pieces 13 which are the same as those described above.

Figure 103:
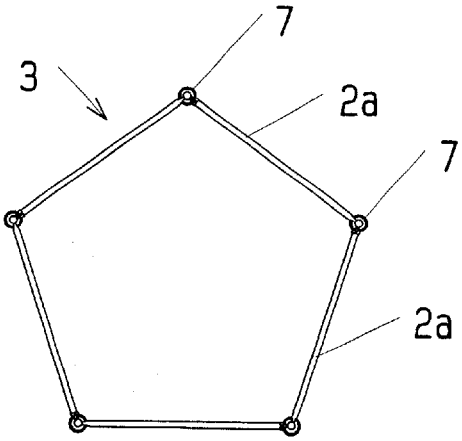
FIG. 103 is a plan view showing a pentagonally assembled state of a frame.
Figure 104:
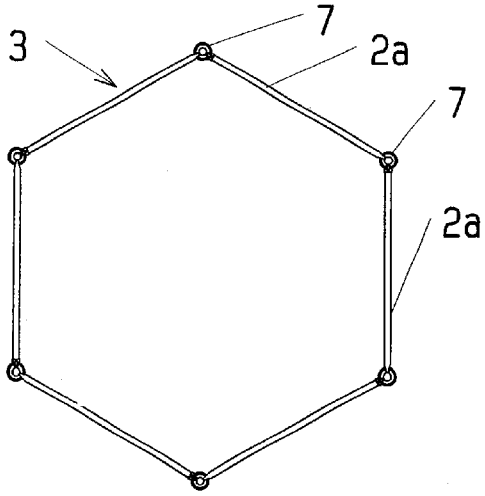
FIG. 104 is a plan view showing a hexagonally assembled state of a frame.

FIG. 103 illustrates a structure which is pentagonal in plan and which is constituted by interconnecting support posts 1 and horizontal members 2*a* as lateral members in any of the frames described above, for example the frame shown in FIG. 48. Likewise, FIG. 104 illustrates a hexagonal structure.

Now, a description will be given below of mounted structures of frames described above according to still further embodiments of the present invention.

Figure 105:
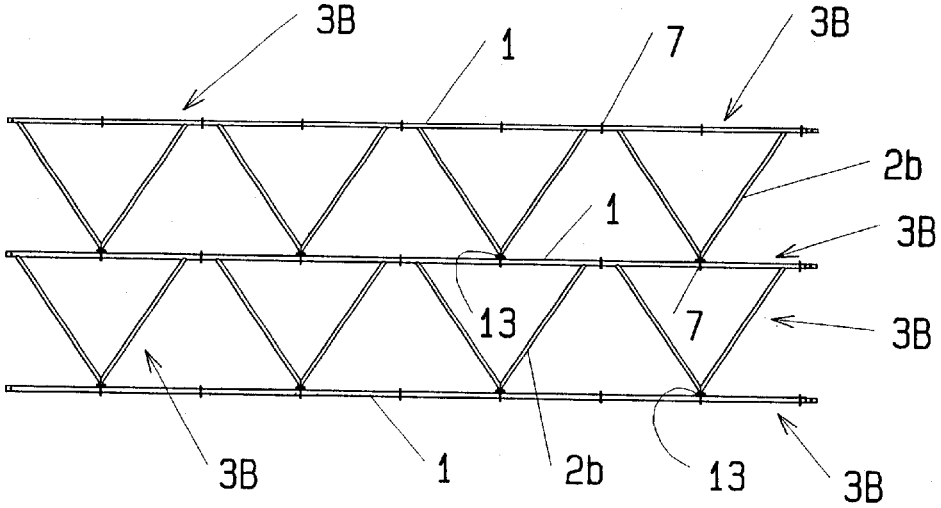
FIG. 105 is a front view of a support beam.

FIG. 105 illustrates a support beam assembled using the frame 3B shown in FIG. 57.

A large number of frames 3B are arranged in both horizontal and vertical directions and the frames 3B adjacent to one another in the lateral direction are connected together through support posts 1, while the frames 3B adjacent in the vertical direction are connected together by engaging a metallic piece 13 of the upper frame with a flange 7 of the lower frame. The support post 1 of the lowest stage of support post 1 is disposed in a 90° shifted manner relative to the support posts 1 located above. Alternatively, there may be used such a single auxiliary support post 1 as shown in FIG. 100.

Figure 106:
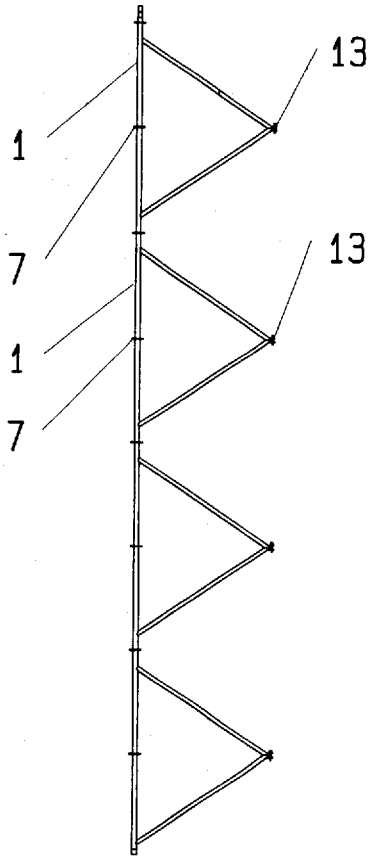
FIGS. 106(A) and (B) are a front view and a side view, respectively, showing a vertically assembled state of a frame.
Figure 106:
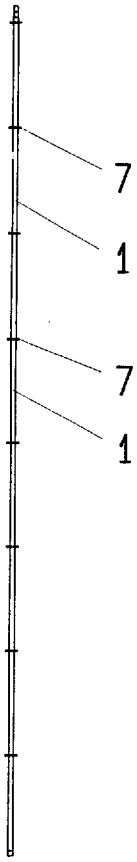

FIGS. 106(A) and (B) illustrate a frame structure in which, as in FIG. 105, a plurality of frames 3B shown in FIG. 57 are stacked and connected together in the vertical direction. This structure can be used as a continuous vertical frame structure for a support beam or a shoring.

Figure 107:
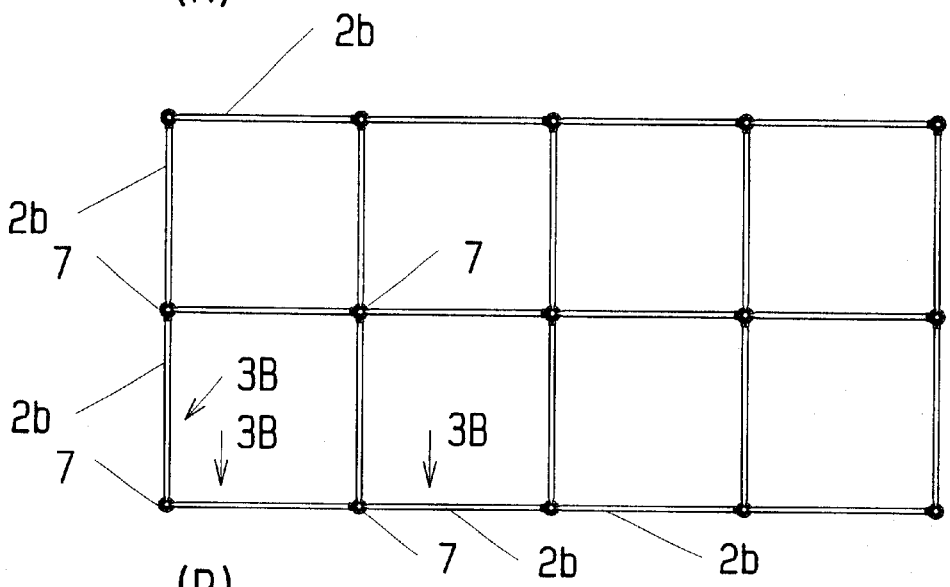
FIGS. 107(A) and (B) are a plan view and a front view, respectively, of a shoring.
Figure 107:
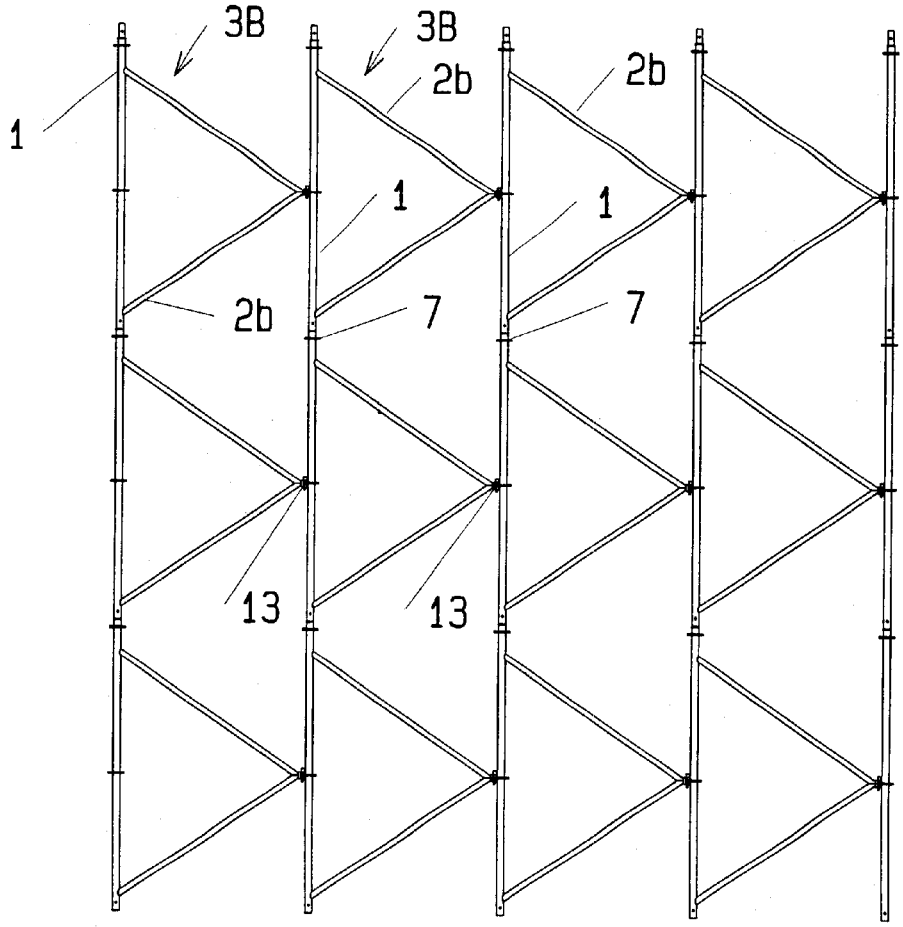

FIGS. 107(A) and (B) illustrate a cubic structure, for example a shoring, fabricated by assembling a plurality of frames 3B shown in FIG. 57 in the vertical, lateral and front, rear directions. In this case, frames each comprising a support post 1 and a V-shaped frame member 2*b* as a lateral member may be assembled horizontally and vertically, or frames comprising a support post 1 and two, three or four frame members 2*b* secured to the support post may be selectively used and assembled. In the frame structure shown in FIG. 107, a large number of frames are connected together in the lateral direction in such a manner that a metallic piece 13 at an outer end of the frame member 2*b* in one support post is connected to an intermediate flange 7 of another support post 1 adjacent thereto.

Figure 108:
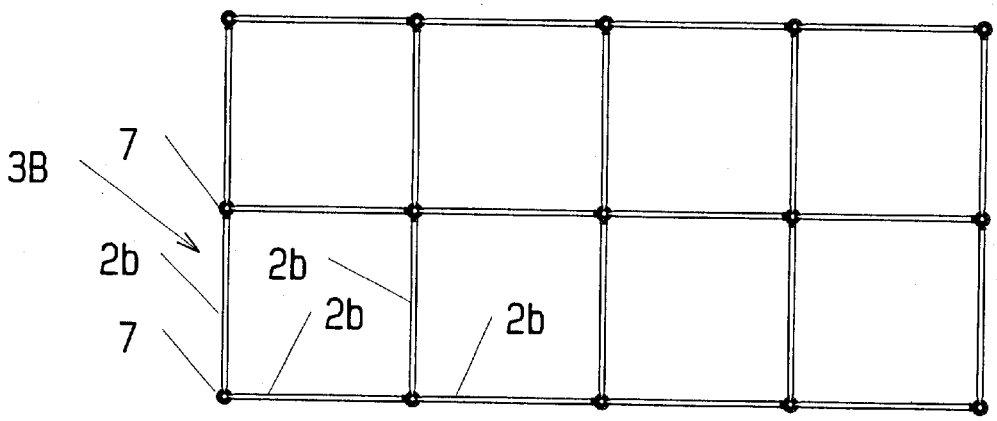
FIGS. 108(A) and (B) are a plan view and a front view, respectively, of a shoring according to a still further embodiment of the present invention.
Figure 108:
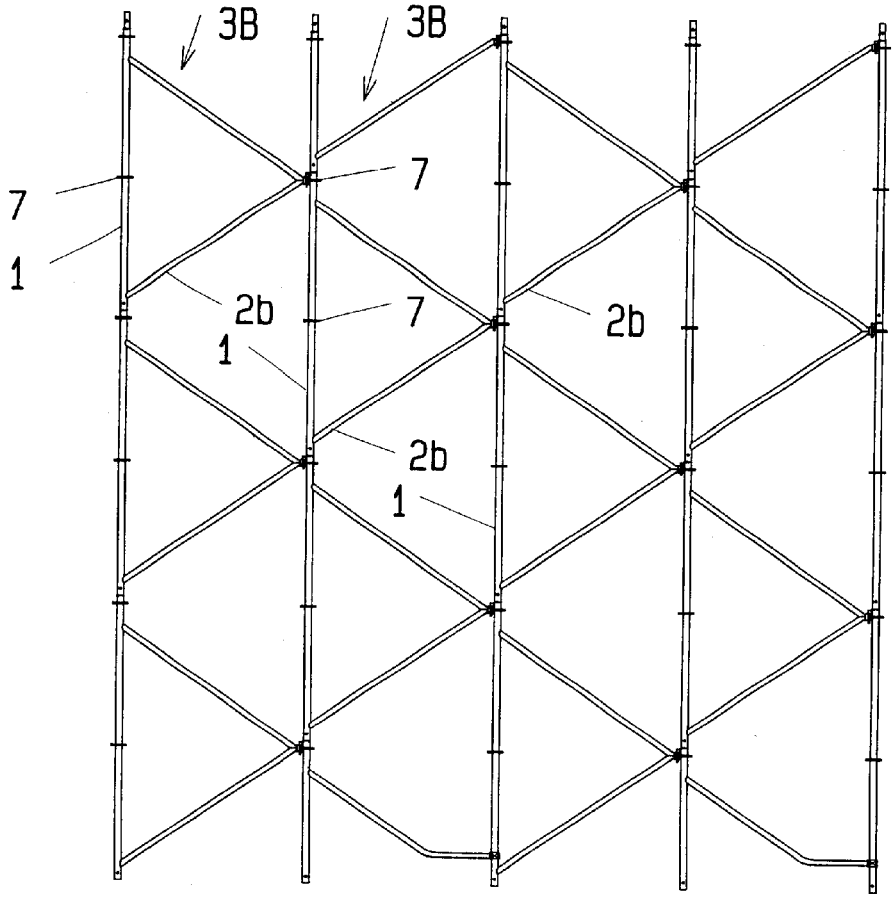

The frame structure shown in FIG. 108 is the same as the frame structure shown in FIG. 108 in that the same frames 3B are assembled horizontally and vertically, but is different in that a metallic piece 13 at an outer end of the V-shaped frame member 2*b* in one support post 1 is connected to an upper flange 7 on another support post 1 side adjacent thereto. According to this structure, for example when a shoring is assembled in a cubic form, components of the frame members 2B are aligned obliquely on the same line and thus can function as braces.

Figure 109:
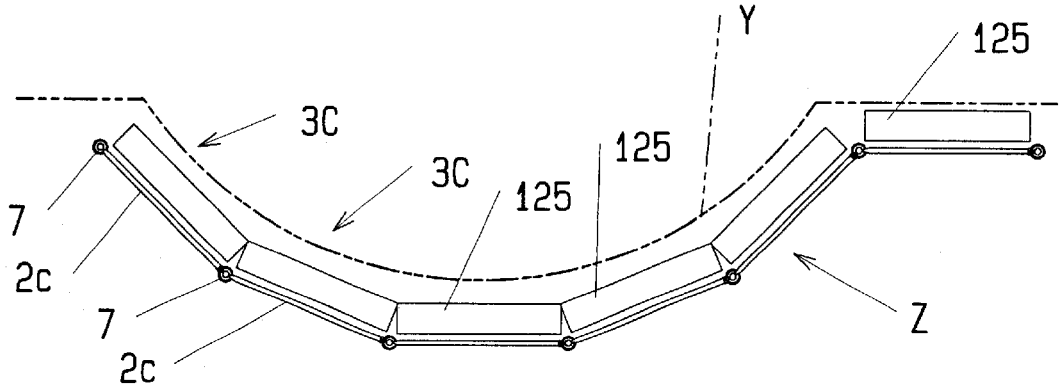
FIGS. 109(A) and (B) are a plan view and a front view, respectively, of a prefabricated scaffolding according to a still further embodiment of the present invention.
Figure 109:
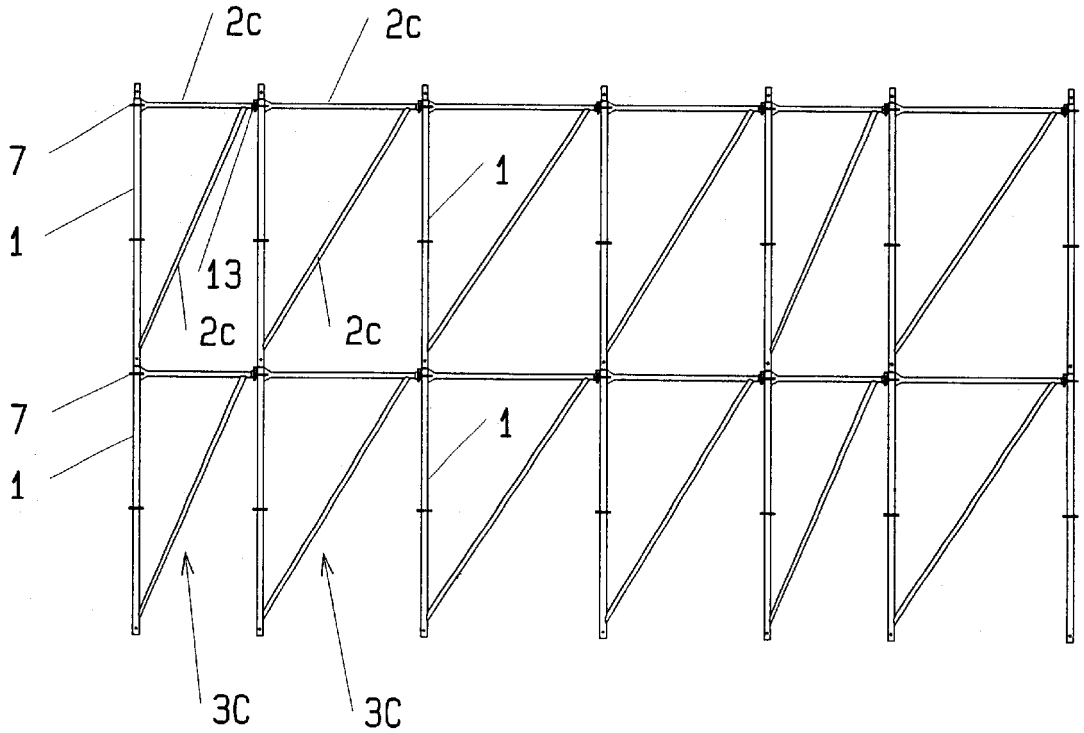

FIG. 109 illustrates a scaffolding frame assembled using a frame embodying the present invention.

The frame used is the frame 3C shown in FIG. 68 and plural such frames 3C are assembled in both vertical and lateral directions. In the vertical direction, upper and lower support posts 1, 1 are connected together, while frames 3C, 3C adjacent in the lateral direction are connected together by connecting the metallic piece 13 at an outer end of the frame member 2C in one support post 1 to the upper flange 7 of the other support post 1. For example, in the case where the outer surface of a building under construction is curved and a scaffolding frame Z is to be assembled along the said outer surface, the scaffolding frame Z is assembled in a continuous manner by changing the mounting angle of the metallic piece 13 in one frame member 2C relative to the flange 7.

Figure 110:
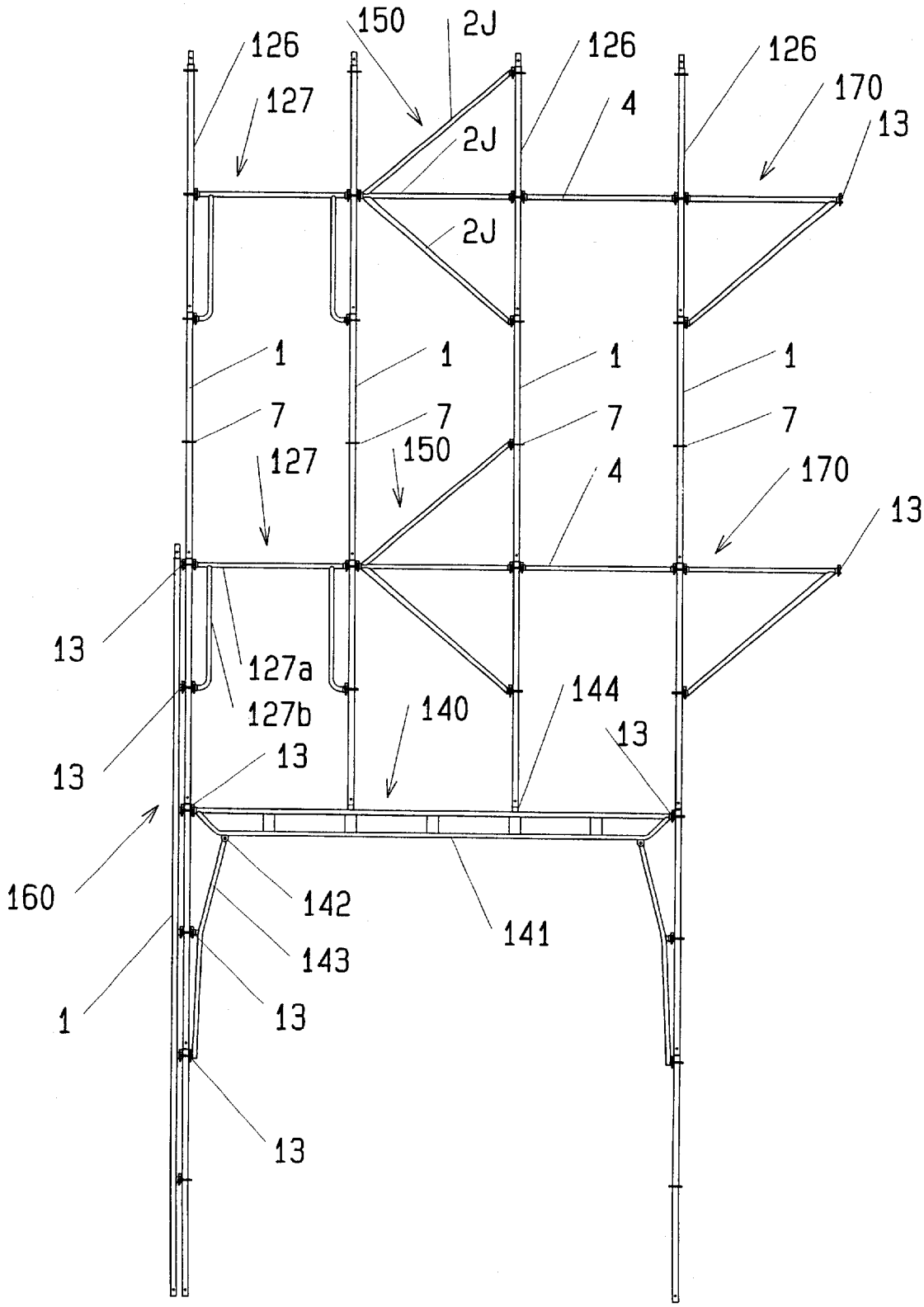
FIG. 110 is an exploded side view of a prefabricated scaffolding.

FIG. 110 is a side view of a prefabricated scaffolding or a shoring which utilizes a frame according to the present invention. Two support frames 1, 1 are disposed upright at front and rear positions, respectively, and a beam member 140 is mounted through metallic pieces 13, below the both-side support posts 1, 1 which are long posts. Reinforcing beams 143, 143 are connected through pins 142 respectively to front and rear (left and right in the figure) underside portions of the beam member 140. The reinforcing members 143, 143 are connected also to the lower portions of the said support posts 1, 1 through metallic pieces 13, 13 so support the beam member 140. Along and in parallel with the left-side support post 1 is raised another support post 160, and both support posts are connected together using metallic pieces 13, whereby the left-side support post 1 is reinforced. The support post 160 comprises a long body and a plurality of metallic pieces 13 fixed thereto. On the beam member 140 are erected a plurality of sockets or bosses 144 and intermediate posts 1, 1 are inserted respectively into the bosses 144 and are held upright. The support posts 1, 1 are interconnected, reinforced and vibration-prevented by means of π-shaped connecting frames 127, auxiliary members 150 of the same structure as that shown in FIG. 101 and horizontal members 4 of the same structure as that shown in FIG. 35, through metallic pieces 13 or flanges 7. The connecting frames 127, auxiliary members 150 and horizontal members 4 are used selectively, and no limitation is made to the illustrated state of connection. The π-shaped connecting frames 127 each comprise a horizontal member 127*a* and two vertical members 127*b*, with metallic pieces 13, 13 being mounted at end portions of the horizontal member 127*a* and the vertical members 127*b*. A large number of support posts 1, 1 are arranged upright to constitute frames 126. Where required, brackets 170 are connected to the front side and scaffolding boards are placed on the brackets 170, on the connecting frames 127 or on the horizontal members 4. It goes without saying that a lateral member is mounted laterally of each support post 1.

Figure 64:
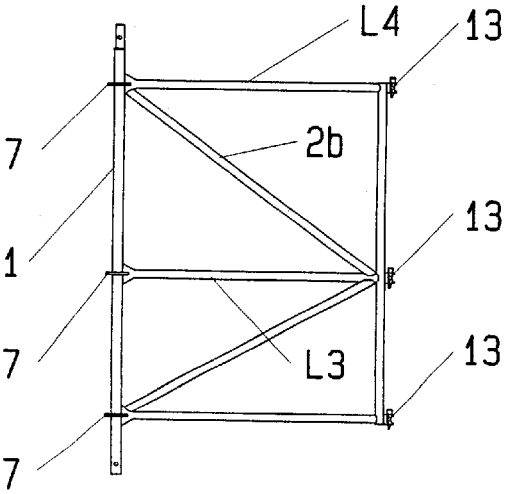
FIG. 64 is a front view of a frame according to a still further embodiment of the present invention.
Figure 111:
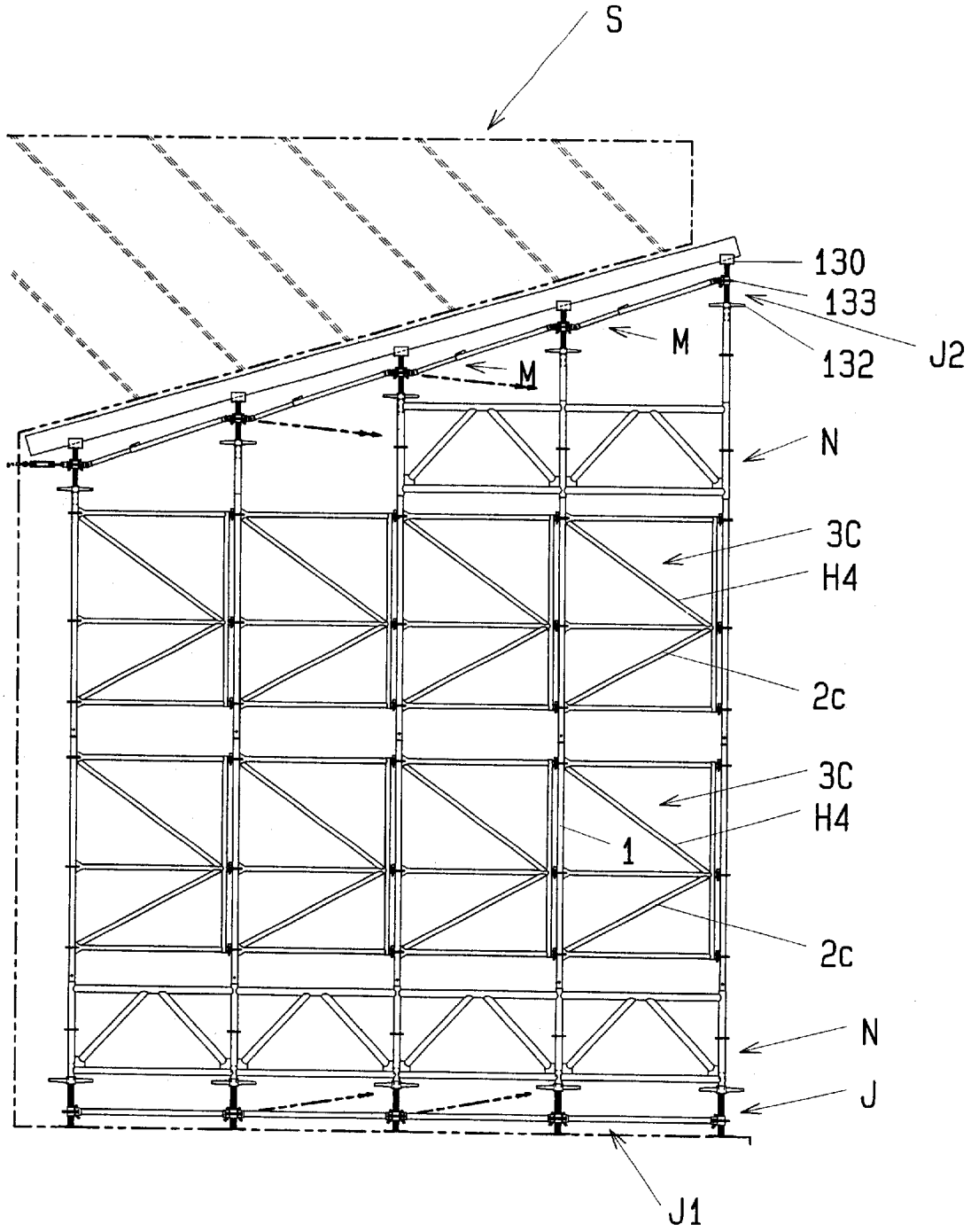
FIG. 111 is a front view of a shoring according to a still further embodiment of the present invention.

FIG. 111 illustrates a structure assembled as scaffolding or shoring, which utilizes the frame 3C shown in FIG. 64 for example. More specifically, a large number of jacks J are disposed upright on the ground and are interconnected and reinforced by connecting members J1. Onto the jacks J is connected a standard frame N and a plurality of frames 3C according to the present invention are connected horizontally and vertically onto the frame N. Further, onto the frame 3C are connected a plurality of frames N stepwise or horizontally, and onto the frame N are mounted other jacks J2 so as to be adjustable in height. The jacks J2 each comprise a bearer portion 130, a screw rod 131 connected to the underside of the bearer portion 130, a flange 133 threadedly engaged with the screw rod 131 movably at an intermediate position of the same rod, and a nut and handle 132 threadedly engaged with the lower portion of the screw rod 131. The screw rod 131 is threadedly connected to a support post through the nut and handle 132. The reason why the frames N are assembled stepwise is because the outer surface of a building S to be constructed is inclined. At the upper end of the frame N are disposed support rods M capable of expansion and retraction, for example such a support rod as shown in FIG. 37. The support rods M are each connected at both ends thereof to the flanges 133 of jacks J2. Thus, jacks J and J2 are used and flanges 133 are mounted on end portion sides of the screw rods 131, further, the connecting member Jl or the support rod M is connected between the flanges 133, so that it is possible to cope with a local load.

Figure 112:
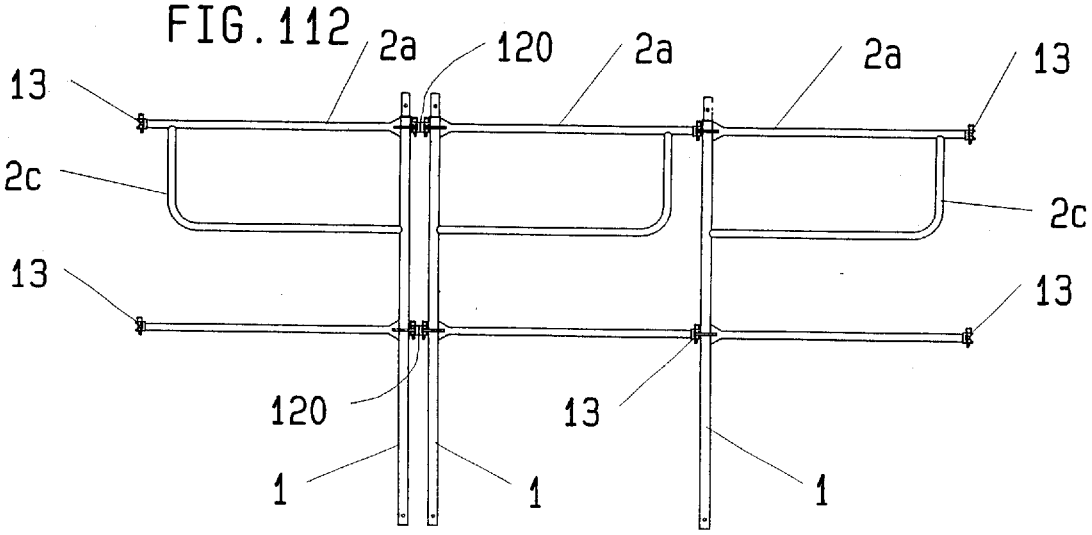
FIG. 112 is a front view showing an assembled state of a frame according to a still further embodiment of the present invention.

FIG. 112 illustrates another connected structure of a frame according to the present invention.

More specifically, a plurality of frames shown in FIG. 52 are connected together in a lateral direction and also in the opposite direction using the connector 120 shown in FIG. 97.

The following effects are attained by the present invention.

(1) Since the frames defined in the claims are each provided with a support post, first and second connector support members provided on the support post, a lateral member, and a connector provided on the lateral member, a plurality of such frames can be assembled in both vertical and lateral directions at a time or can be attached to another structure in a simple manner, thus permitting easy assembly of structures of various patterns. In other words, it is not necessary to provide various frames for various structures, and thus the claimed frames are superior in both versatility and assembling performance.

(2) On the support post are mounted a lateral member and a connector at an outer end of the lateral member, so it is not necessary to take the trouble to provide a connecting member for the support post. Besides, even after the assembly of support posts, any of the support posts can be removed for replacement by removing the connector. Moreover, by connecting the lateral member to the associated support post itself or selectively to the first or the second connector support member, frames can be coupled together at the same height or at different heights in accordance with the mounted position of each lateral member.

(3) Since the first connector support member is mounted at an intermediate position of the support post, it is possible to connect the support post and a reinforcing frame to the said connector support member and hence possible to prevent buckling of the support post. Besides, since the first and second connector support members are mounted at an intermediate position and an upper or lower position of the support post, it is possible to assemble a scaffold at a height conforming to the height of the selected first or second connector support member. Particularly, when a scaffolding board is mounted through the first connector support member located at an intermediate position, it is possible to dispose the scaffolding board below the balustrade.

(4) Further, since a lateral member is secured to each support post, when a prefabricated scaffolding, a shoring, or a support beam, is assembled using frames comprising such support posts and lateral members, the lateral members each serve as both a connecting member and a reinforcing brace, so it is not necessary use braces.

What is claimed is:

1. A scaffold arrangement comprising:

a support post having an axial direction and a radial direction, said support post including first and second ends;

a first support post connector arranged at said first end of said support post, said first support post connector including a flange welded to said support post;

a second support post connector arranged at a substantially axial middle of said support post, said second support post connector including a flange welded to said support post;

an end radial member extending radially from said support post, said end radial member having first and second ends, said first end of said end radial member being connected to said first support post connector;

a first lateral connector ranged on said second end of said end radial member, said first lateral connector and said first support post connector being arranged at a some axial distance from one of the ends of said support post;

a diagonal member having a first and second end, said first end of said diagonal member extending from said second end of said support post in both said radial and axial directions of said support post;

a second lateral connector arranged on said second end of said diagonal member, said second lateral connector and said second end of said diagonal member being arranged at a substantially same axial distance from one of the ends of said support post as said second support post connector.

2. A scaffold arrangement in accordance with claim 1, further comprising:

a lateral post extending from said second end of said diagonal member to said second end of said end radial member, said support post, said end radial member, said diagonal member, and said lateral post being arranged in substantially a same plane.

3. A scaffold arrangement in accordance with claim 2, further comprising:

another radial member extending from said support post to said lateral post;

still another radial member extending from said support post to said lateral post.

4. A scaffold arrangement in accordance with claim 2, wherein:

said diagonal member is rigidly connected to said support post;

said lateral post is rigidly connected to said diagonal member and said end radial member;

said support post, said end radial member, said diagonal members, said lateral post and all of said connectors form a fire body, a plurality of said frame bodies are provided and are connected together;

said first and second support post connectors of one said frame body being connected to said first and second lateral connectors of another said frame body respectively.

5. A scaffold arrangement in accordance with claim 4, further comprising:

a walkway connected to said plurality of frame bodies, said end radial members and portions of said support posts of said frame bodies forming a balustrade for said walkway.

6. A scaffold arrangement in accordance with claim 1, further comprising:

a middle radial member extending from said second support post connector to said second end of said diagonal member.

7. A scaffold arrangement in accordance with claim 6, further comprising:

a lateral post extending from said second end of said diagonal member to said second end of said end radial member, said support post, said end radial member, said middle radial member, said diagonal member, and said lateral post being arranged in substantially a same plane.

8. A scaffold arrangement in accordance with claim 1, further comprising:

another diagonal member having a first end and a second end, said first end of said another diagonal member being connected to said support post, said another diagonal member extending both axially and radially from said support post to said second end of said diagonal member.

9. A scaffold arrangement in accordance with claim 8, wherein:

said first end of said another diagonal member is connected to said support post on a side diametrically opposite a connection of said diagonal member to said support post.

10. A scaffold arrangement in accordance with claim 8, further comprising:

a middle radial member extending from said second support post connector to said second end of said diagonal member.

11. A scaffold arrangement in accordance with claim 8, further comprising:

a lateral post extending from said second end of said diagonal member to said second end of said end radial members, said support post, said end radial member, said middle radial member, said diagonal member, and said lateral post being arranged in substantially a same plane.

12. A scaffold arrangement in accordance with claim 1, further comprising:

another support post connector arranged at said second end of said support post;

another end radial member extending radially from said another support post connector, said another end radial member having fist and second ends, said first end of said another end radial member being connected to said another support post connector;

a lateral post extending from said second end of said end radial member to said second end of said another end radial member;

a middle radial member extending from said second support post connector to said second end of said diagonal member;

another, diagonal member having a first end and a second end, said first end of said another diagonal member being connected to said support post, said another diagonal member extending both axially and radially from said support post to said second end of said diagonal member.

13. A scaffold arrangement in accordance with claim 1, wherein:

said first lateral connector is of a connector type connectable to a flange of a first support post connector of an adjacent one of said scaffold arrangements.

14. A scaffold arrangement in accordance with claim 13, wherein:

another radial member extends from said support post to said lateral post;

said second lateral connector and said second support post connector are arranged at a same axial position of said support post;

said type of connector interlocks with said flange of said first support post connector;

said type of connector includes pieces for clamping onto said flange of said first support post connector;

said flange of said first support post connector is connectable to a plurality of connectors of said connector type;

said second lateral connector is of said connector type and is connectable to said flange of said second support post connector;

said type of connector interlocks with said flange of said second support post connector;

said type of connector includes pieces for clamping onto said flange of said second support post connector;

said flange of said second support post connector is connectable to a plurality of connectors of said connector type.

15. A unitary frame body arrangement comprising:

a plurality of frame bodies connected together, each frame body including:

a support post with first and second ends, said first end of said support post including a spigot portion connectable to a second end of an axially adjacent one of said plurality of frame bodies;

a first support connector comprising a flange welded to a middle of the support post;

a second support connector comprising a flange welded to an upper portion of the support post;

a lateral member comprising a frame secured to a side portion of the support post, and connectors comprising metallic pieces mounted at an outer end of the frame at vertical positions corresponding to the flanges respectively, said frame being composed of a horizontal member whose base end is connected to said flange at said upper portion, a vertical member which is integrally connected to an end portion of the horizontal member, and a diagonal member integrally connected to a lower end of the vertical member and to a lower portion of the support post, whereby a trapezoidal frame in front view is formed by said support post and said frame, said connectors of said lateral members being connected to said flanges of a radially adjacent one of said plurality of frame bodies;

a walkway connected to said plurality of frame bodies, said frame bodies forming a balustrade for said walkway.

16. A frame body arrangement according to claim 15, wherein at least one horizontal reinforcing members are integrally laid between the support post and the vertical member.

17. A frame body arrangement according to claim 15, wherein a horizontal reinforcing member is integrally laid between the support post and the vertical member, and another horizontal reinforcing member is integrally laid between the flange welded to the middle of the support post and the vertical member.

18. A frame body arrangement according to claim 15, wherein a horizontal reinforcing member is integrally laid between the flange welded to the middle of the support post and the vertical member, and a diagonal member for reinforement is laid between the horizontal reinforcing member anal the horizontal member.

19. A unitary frame body arrangement comprising:

a plurality of frame bodies connected together, each frame body including:

a support post with first and second ends, said first end of said support post including a spigot portion connectable to a second end of an axially adjacent one of said plurality of frame bodies;

a first support connector, a second support connector and a third support connector each comprising flanges welded to a middle of the support post, an upper portion thereof and a lower portion thereof, respectively;

a lateral member comprising a V-shaped frame whose base end is secured to a side portion of the support post through the upper flange and the lower flange;

lateral connectors comprising metallic pieces mounted at, an outer end of the frame at vertical positions corresponding to the flanges respectively, said lateral connectors being connected to said flanges of a radially adjacent one of said plurality of frame bodies;

a reinforcing member comprising a horizontal frame laid between a middle portion of the frame and the middle flange of the support post; and diagonal members comprising a pair of upper and lower frames laid between the middle portion of the V-shaped frame and the upper and lower flanges;

a walkway connected to said plurality of frame bodies, said frame bodies forming a balustrade for said walkway.

20. A unitary frame body arrangement comprising:

a plurality of frame bodies connected together, each frame body including:

a support post with first and second ends, said first end of said support post including a spigot portion connectable to a second end of an axially adjacent one of said plurality of frame bodies;

a first support connector comprising a middle flange welded to a middle of the support post;

a second support connector comprising an upper flange welded to an upper portion of the support post;

a first lateral member comprising a horizontal member whose base end is secured to the upper flange;

a second lateral member comprising a horizontal member whose base end is secured to the middle;

lateral connectors comprising metallic pieces mounted at outer ends of the horizontal members at vertical positions corresponding to the upper flange and the middle flange, respectively, said lateral connectors being connected to said flanges of a radially adjacent one of said plurality of frame bodies;

braces comprising diagonal members laid in a diagonal direction between each of the horizontal members and a side portion of the support post;

a walkway connected to said plurality of frame bodies, said frame bodies forming a balustrade for said walkway.

* * * * *

UNITED STATES PATENT AND TRADEMARK OFFICE

CERTIFICATE OF CORRECTION

PATENT NO. : 6,450,291 B1
DATED : September 17, 2002
INVENTOR(S) : Ono

It is certified that error appears in the above-identified patent and that said Letters Patent is hereby corrected as shown below:

Title page,
Item [73], delete "Nisso Sangyo,Co., Ltd.(JP)"

Signed and Sealed this

Thirteenth Day of May, 2003

JAMES E. ROGAN
*Director of the United States Patent and Trademark Office*